US010058205B2

(12) United States Patent
Rivera et al.

(10) Patent No.: US 10,058,205 B2
(45) Date of Patent: Aug. 28, 2018

(54) AUTOMATIC AND DYNAMIC TORQUE CALIBRATION FOR DRAPERY TRACK SYSTEM

(71) Applicant: Crestron Electronics, Inc., Rockleigh, NJ (US)

(72) Inventors: Luis Rivera, Dumont, NJ (US); Benjamin Slivka, Hillsdale, NJ (US); Charles R. Derk, Jr., Park Ridge, NJ (US)

(73) Assignee: Crestron Electornics, Inc., Rockleigh, NJ (US)

( * ) Notice: Subject to any disclaimer, the term of this patent is extended or adjusted under 35 U.S.C. 154(b) by 26 days.

(21) Appl. No.: 15/397,438

(22) Filed: Jan. 3, 2017

(65) Prior Publication Data

US 2017/0112316 A1 Apr. 27, 2017

Related U.S. Application Data

(63) Continuation-in-part of application No. 15/363,405, filed on Nov. 29, 2016, now Pat. No. 9,970,234, (Continued)

(51) Int. Cl.

| | |
|---|---|
| ***E06B 9/68*** | (2006.01) |
| ***A47H 5/02*** | (2006.01) |
| ***E06B 9/32*** | (2006.01) |

(52) U.S. Cl.

CPC ..... *A47H 5/02* (2013.01); *E06B 9/32* (2013.01); *E06B 9/68* (2013.01); (Continued)

(58) Field of Classification Search

CPC ..... A47H 5/02; A47H 2005/025; E06B 9/32; E06B 9/68; E06B 2009/6854; E06B 2009/6845; E06B 2009/6809

See application file for complete search history.

(56) References Cited

U.S. PATENT DOCUMENTS 6,870,334 B2 * 3/2005 Jurado ..... G05B 13/0265 318/282
6,940,240 B2 * 9/2005 Kelkhoff ..... E06B 9/68 318/282

(Continued)

*Primary Examiner* — Katherine W Mitchell
*Assistant Examiner* — Abe Massad
(74) *Attorney, Agent, or Firm* — Crestron Electronics, Inc

(57) ABSTRACT

A drapery track assembly is disclosed that performs an automatic and dynamic torque calibration to enable automatic detection of pulling of the drape as well as obstacles in order to minimize damage to the drapery track assembly and users. The drapery track assembly comprises a track, a drape attached to the track, a motor configured for moving the drape along the track, a sensor configured for sensing a position of the drape along the track, a current sensing circuit configured for detecting current levels, and a controller configured for controlling the motor and comprising at least one memory. The controller is configured for determining and storing a multi-point overcurrent threshold (OCTH) profile in each direction of travel comprising a plurality of overcurrent threshold (OCTH) values for each segment of travel along the track. The controller uses these multi-point overcurrent threshold (OCTH) profiles during normal operation to detect an overcurrent event and perform an overcurrent operation when a measured current level within a travel segment exceeds the overcurrent threshold (OCTH) value of that travel segment.

34 Claims, 12 Drawing Sheets

Related U.S. Application Data which is a continuation of application No. 14/242,175, filed on Apr. 1, 2014, now Pat. No. 9,534,442.

(52) U.S. Cl.
CPC ..... *A47H 2005/025* (2013.01); *E06B 2009/6809* (2013.01); *E06B 2009/6845* (2013.01); *E06B 2009/6854* (2013.01)

(56) References Cited

U.S. PATENT DOCUMENTS

| | | | | |
|---|---|---|---|---|
| 7,339,336 | B2 * | 3/2008 | Gregori | G05B 13/0265 318/282 |
| 9,534,442 | B2 * | 1/2017 | Derk, Jr. | E06B 9/50 |
| 2012/0173024 | A1 * | 7/2012 | Feldstein | A47H 5/0325 700/275 |
| 2017/0074038 | A1 * | 3/2017 | Derk, Jr. | E06B 9/50 |

* cited by examiner

AUTOMATIC AND DYNAMIC TORQUE CALIBRATION FOR DRAPERY TRACK SYSTEM

CROSS-REFERENCE TO RELATED APPLICATIONS

This application is a continuation-in-part of U.S. application Ser. No. 15/363,405, filed on Nov. 29, 2016, which is a continuation of U.S. application Ser. No. 14/242,175, filed on Apr. 1, 2014, and issued as U.S. Pat. No. 9,534,442 on Jan. 3, 2017, the entire contents of which are expressly incorporated herein by reference.

BACKGROUND OF THE INVENTION

Technical Field

Aspects of the embodiments relate generally to drapery track systems, and more specifically to systems, methods, and modes for automatic and dynamic torque calibration for a drapery track system to enable automatic detection of pulling of the drape as well as obstacles to minimize damage to the drapery track system or users.

Background Art

Drapery track systems for use to cover openings or fixtures in residential and commercial settings have made significant improvements in recent years. A drapery track system typically consists of a track, track carriers, drapes attached to the track carriers, and a mechanism for moving the drapes back and forth along the track. The track is mounted either to a wall or ceiling and the mechanism for moving the drapes can be as simple as a pull cord-pulley system.

More sophisticated drapery track systems use a motor to move the drapes along the track. Motorized drapery track systems can be automated to automatically open and close. Unlike a manually controlled drapery system, where the user walks up to the window and opens or closes the drape using a cord, a wand, or by pulling on the drape, motorized drapery systems make it easy to open or close one or multiple drapes with the touch of a button, or by programming them to automatically move at a specific time with no direct user interaction.

Due to the automated nature of movement of motorized drapery track systems, a user may not realize if there is an obstruction. An obstruction may interfere with the drapery's movement. If a drapery is being closed and encounters an obstruction, the drapery fabric normally will bunch up. Damage may further occur to the fabric, the motor, or hardware, if the drapery gets caught and pulled by the obstruction during opening of the drape.

Accordingly, a need has arisen for a drapery track system that can perform an automatic and dynamic torque calibration to enable automatic detection of pulling of the drape as well as obstacles in order to minimize damage to the drapery track system and users.

SUMMARY OF THE INVENTION

It is an object of the embodiments to substantially solve at least the problems and/or disadvantages discussed above, and to provide at least one or more of the advantages described below.

It is therefore a general aspect of the embodiments to provide systems, methods, and modes for drapery track systems that will obviate or minimize problems of the type previously described.

It is an aspect of the embodiment to provide systems, methods, and modes for providing a drapery track system that automatically detects pulling of the drape as well as obstacles to minimize damage to the drapery track system and/or to a user operating the drapery track system.

It is a further aspect of the embodiment to provide systems, methods, and modes for automatic and dynamic torque calibration of a drapery track system to enable the automatic detection of pulling of the drape as well as obstacles.

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter.

Further features and advantages of the aspects of the embodiments, as well as the structure and operation of the various embodiments, are described in detail below with reference to the accompanying drawings. It is noted that the aspects of the embodiments are not limited to the specific embodiments described herein. Such embodiments are presented herein for illustrative purposes only. Additional embodiments will be apparent to persons skilled in the relevant art(s) based on the teachings contained herein.

DISCLOSURE OF INVENTION

According to a first aspect of the embodiments, a drapery track assembly is provided comprising a track, at least one drape attached to the track, a motor configured for moving the drape along the track, a sensor configured for sensing a position of the drape along the track, a current sensing circuit configured for detecting current levels, and a controller configured for controlling the motor and comprising at least one memory. The controller is configured for determining a multi-point overcurrent threshold (OCTH) profile by: (a) storing positions of a plurality of travel segments of a full run of the drape along the track; (b) moving the drape along the track; for each traveled travel segment: (c) capturing a plurality of current levels during travel; (d) calculating an overcurrent threshold (OCTH) value using the captured current levels; and (e) storing the overcurrent threshold (OCTH) values in the memory. The controller uses the multi-point overcurrent threshold (OCTH) profile during normal operation to detect an overcurrent event and perform an overcurrent operation.

According to an embodiment, the controller determines a first multi-point overcurrent threshold (OCTH) profile for an opened to closed direction and a second multi-point overcurrent threshold (OCTH) profile for a closed to opened direction. The first multi-point overcurrent threshold (OCTH) profile may be determined by moving the drape through substantially the full run along the track in the opened to closed direction, and the second multi-point overcurrent threshold (OCTH) profile may be determined by moving the drape through substantially the full run along the track in the closed to opened direction.

According to an embodiment, the multi-point overcurrent threshold (OCTH) profile comprises a vector of the overcurrent threshold (OCTH) values. According to an embodiment, in determining the multi-point overcurrent threshold (OCTH) profile, the controller is further configured for dividing the full run of the drape along the track into the plurality of travel segments. The full run of the drape along the track may comprise a run of the drape from a close hard limit to an open hard limit or from an open hard limit to a close hard limit. The controller may automatically determine the positions of the plurality of travel segments by: (i) determining the close hard limit by directing the motor to move the drape to a fully closed position until the drape reaches a closed physical hard limit; (ii) determining the open hard limit by directing the motor to move the drape to a fully opened position until the drape reaches an opened physical hard limit; and (iii) dividing the full run of the drape along the track into the plurality of travel segments. According to an embodiment, the controller may be configured for determining the multi-point overcurrent threshold (OCTH) profile by moving the drape through substantially the full run by moving the drape from a substantially opened position to a substantially closed position or moving the drape from a substantially closed position to a substantially opened position.

According to an embodiment, the memory may store a fixed minimum value ($F_v$), and wherein for each traveled travel segment the controller calculates the overcurrent threshold (OCTH) value by: (i) determining a peak value ($P_v$) of the plurality of the captured current levels; (ii) determining a percentage of an average value ($A_v$) of the plurality of the captured current levels; and (iii) adding the fixed minimum value ($F_v$), the peak value ($P_v$), and the percentage of an average value ($A_v$). According to an embodiment, for each traveled travel segment the controller may filter out bad data by discarding captured current levels that equal to zero or exceed an allowable current level range. The percentage of an average value ($A_v$) may be determined by calculating an average of the plurality of the captured current levels of the traveled travel segment, and calculating a percentage of that average. According to an embodiment, the percentage may be a predetermined percentage value stored in the memory and comprises a value in a range of about 5% to about 25%.

According to an embodiment, for each given traveled travel segment the controller may determine the overcurrent threshold (OCTH) value by comparing the calculated overcurrent threshold (OCTH) value of the given travel segment to an overcurrent threshold (OCTH) value of a preceding travel segment. When the calculated overcurrent threshold (OCTH) value of the given travel segment is larger than the overcurrent threshold (OCTH) value of a preceding travel segment, the controller stores the calculated overcurrent threshold (OCTH) value of the given travel segment. When the calculated overcurrent threshold (OCTH) value of the given travel segment is smaller than the overcurrent threshold (OCTH) value of a preceding travel segment, the controller discards the calculated overcurrent threshold (OCTH) value of the given travel segment, and storing the overcurrent threshold (OCTH) value of the preceding travel segment for the given travel segment.

According to an embodiment, the multi-point overcurrent threshold (OCTH) profile may be automatically determined upon the drapery track assembly's installation in the field, during a first operation of the drapery track assembly, after a power up of the drapery track assembly, upon receiving a command to determine the multi-point overcurrent threshold (OCTH) profile, upon receiving a reset command, when the speed of the motor is changed, or when a closed or opened hard limits are changed. According to an embodiment, the multi-point overcurrent threshold (OCTH) profile may be automatically determined by updating the multi-point overcurrent threshold (OCTH) profile during normal operation of the drapery track assembly. According to an embodiment, the controller may update the multi-point overcurrent threshold (OCTH) profile when (a) the drape travels through substantially the full run along the track, and (b) the drape reaches a fully opened position or a fully closed position with no overcurrent event.

According to an embodiment, the controller may be further configured for: (i) waiting for the drape to be at or near an opened hard limit; (ii) waiting for a control command to move the drape to a fully closed position; (iii) when the drape reaches the fully closed position with no overcurrent event, determining a multi-point overcurrent threshold (OCTH) profile in an opened to closed direction; (iv) when an overcurrent event was detected, discarding the captured plurality of current levels. According to an embodiment, the drape is near the opened hard limit when the drape is within about 10% of the opened hard limit. According to another embodiment, the controller may be further configured for: (i) waiting for the drape to be at or near a closed hard limit; (ii) waiting for a control command to move the drape to a fully opened position; (iii) when the drape reaches a fully opened position with no overcurrent event, determining a multi-point overcurrent threshold (OCTH) profile in a closed to opened direction; (iv) when an overcurrent event was detected, discarding the captured plurality of current levels. According to an embodiment, the drape is near the closed hard limit when the drape is within about 10% of the closed hard limit.

According to an embodiment, during a normal operation the controller may be configured for detecting the overcurrent event by: (i) measuring current levels as the drape travels along the track; and (ii) detecting an overcurrent event when a measured current level within a travel segment exceeds the overcurrent threshold (OCTH) value of that travel segment. According to a further embodiment, during normal operation the controller may be further configured for detecting the overcurrent event by: (i) receiving a control command to move the drape; (ii) tracking position to determine present travel segment; (iii) measuring current levels as the drape travels within the present travel segment; and (iv) comparing each measured current level to the overcurrent threshold (OCTH) value that corresponds to the present travel segment. The overcurrent operation may comprise at least one of stopping the motor, and stopping and reversing the motor by a predetermined number of revolutions. According to an embodiment, upon detecting the overcurrent event, the controller may be further configured for: (i) continuing moving the drape and measuring current levels; (ii) determining whether a length of time of the overcurrent event is larger than a predetermined maximum amount of time; (iii) when the overcurrent event time is smaller than the maximum amount of time, resuming normal operation; (iv) when the overcurrent event time is larger than the maximum amount of time, performing the overcurrent operation. According to an embodiment, when the controller receives a control command to move the drape after detecting the overcurrent event, the controller cancels the overcurrent operation.

According to an embodiment, the drapery track assembly may further comprise a proportional-integral-derivative (PID) controller configured for maintaining the speed of the drape by varying the power of the motor. Upon detecting the overcurrent event, the controller is further configured for: (i) preventing the proportional-integral-derivative (PID) controller from increasing power to the motor; (ii) continuing moving the drape and measuring current levels; (iii) determining whether a length of time of the overcurrent event is larger than a predetermined maximum amount of time; (iv) when the overcurrent event time is smaller than the maximum amount of time, resuming normal operation of the proportional-integral-derivative (PID) controller; (v) when the overcurrent event time is larger than the maximum amount of time, performing the overcurrent operation. According to an embodiment, preventing the proportional-integral-derivative (PID) controller from increasing power to the motor may comprise pausing the proportional-integral-derivative (PID) controller. The overcurrent operation may comprise at least one of stopping the motor, and stopping and reversing the motor by a predetermined number of revolutions.

According to another aspect of the embodiments, a drapery track assembly is provided comprising a track, at least one drape attached to the track, a motor configured for moving the drape along the track, a sensor configured for sensing a position of the drape along the track, a current sensing circuit configured for detecting current levels, and a controller configured for controlling the motor and comprising at least one memory. The controller is configured for determining at least one overcurrent threshold (OCTH) value by: moving the drape along the track; capturing a plurality of current levels during travel; determining at least one overcurrent threshold (OCTH) value; and storing the overcurrent threshold (OCTH) value in the memory. The controller is further configured for detecting an overcurrent event by: receiving a control command to move the drape; measuring current levels as the drape travels along the track; detecting an overcurrent event when a measured current level exceeds the at least one overcurrent threshold (OCTH) value; continuing moving the drape and measuring current levels; determining whether a length of time of the overcurrent event is larger than a predetermined maximum amount of time; when the overcurrent event time is smaller than the maximum amount of time, resuming normal operation of the drape; when the overcurrent event time is larger than the maximum amount of time, performing an overcurrent operation.

According to an embodiment, the drapery track assembly may further comprise a proportional-integral-derivative (PID) controller configured for maintaining the speed of the drape by varying the power of the motor, wherein the controller is further configured for: upon detecting the overcurrent event, preventing the proportional-integral-derivative (PID) controller from increasing power to the motor; and when the overcurrent event time is smaller than the maximum amount of time, resuming normal operation of the proportional-integral-derivative (PID) controller; when the overcurrent event time is larger than the maximum amount of time, continuing to prevent the proportional-integral-derivative (PID) controller from increasing power to the motor. According to an embodiment, preventing the proportional-integral-derivative (PID) controller from increasing power to the motor may comprise pausing the proportional-integral-derivative (PID) controller.

According to another aspect of the embodiments, a drapery track assembly is provided comprising a track, at least one drape attached to the track, a motor configured for moving the drape along the track, a sensor configured for sensing a position of the drape along the track, a current sensing circuit configured for detecting current levels, and a controller configured for controlling the motor and comprising at least one memory. The controller may be configured for determining at least one overcurrent threshold (OCTH) value by: (a) storing a fixed minimum value ($F_v$) (b) moving the drape along the track; (c) capturing a plurality of current levels; (d) calculating the at least one overcurrent threshold (OCTH) value by: (i) determining a peak value ($P_v$) of at least a subset of the plurality of the captured current levels; (ii) determining a percentage of an average value ($A_v$) of at least the subset of the plurality of the captured current levels; and (iii) adding the fixed minimum value ($F_v$), the peak value ($P_v$), and the percentage of an average value ($A_v$), and (e) storing the at least one overcurrent threshold (OCTH) value in the memory. The controller uses the at least one overcurrent threshold (OCTH) value during normal operation to detect an overcurrent event and perform an overcurrent operation.

According to an embodiment, the at least one overcurrent threshold (OCTH) value may automatically updated during normal operation of the drapery track assembly when (a) the drape travels through substantially the full run along the track, and (b) the drape reaches a fully opened position or a fully closed position with no overcurrent event.

According to another aspect of the embodiments, a motorized window treatment assembly is provided comprising: a window covering material; a motor configured for moving the window covering material from an opened position to a closed position; a sensor configured for sensing a position of the window covering material; a current sensing circuit configured for detecting current levels; and a controller configured for controlling the motor and comprising at least one memory. The controller may be configured for determining a multi-point overcurrent threshold (OCTH) profile by: (a) storing positions of a plurality of travel segments of a full run of the window covering material from a fully closed position to a fully opened position or from a fully opened position to a fully closed position; (b) moving the window covering material; for each traveled travel segment: (c) capturing a plurality of current levels during travel; (d) calculating an overcurrent threshold (OCTH) value using the captured current levels; and (e) storing the overcurrent threshold (OCTH) values in the memory. The controller uses the multi-point overcurrent threshold (OCTH) profile during normal operation to detect an overcurrent event and perform an overcurrent operation. The controller may determine a first multi-point overcurrent threshold (OCTH) profile for an opened to closed direction and a second multi-point overcurrent threshold (OCTH) profile for a closed to opened direction.

BRIEF DESCRIPTION OF THE DRAWINGS

The above and other objects and features of the embodiments will become apparent and more readily appreciated from the following description of the embodiments with reference to the following figures. Different aspects of the embodiments are illustrated in reference figures of the drawings. It is intended that the embodiments and figures disclosed herein are to be considered to be illustrative rather than limiting. The components in the drawings are not necessarily drawn to scale, emphasis instead being placed upon clearly illustrating the principles of the aspects of the embodiments. In the drawings, like reference numerals designate corresponding parts throughout the several views.

BRIEF DESCRIPTION OF THE SEVERAL VIEWS OF THE DRAWINGS

Figure 1:
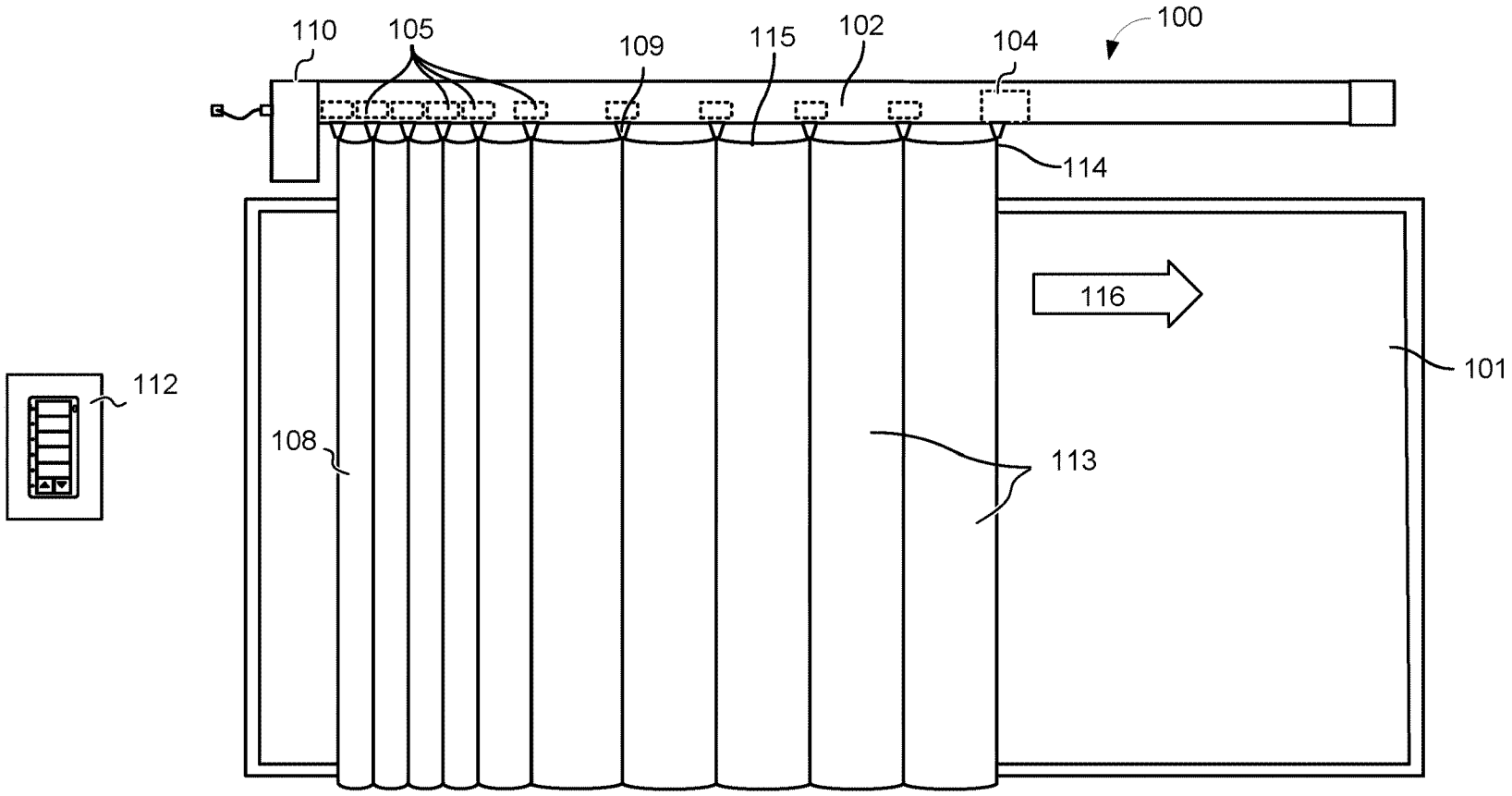

FIG. 1 illustrates an exemplary motorized drapery track assembly traveling in a closing direction according to an illustrative aspect of the embodiments.

Figure 2:
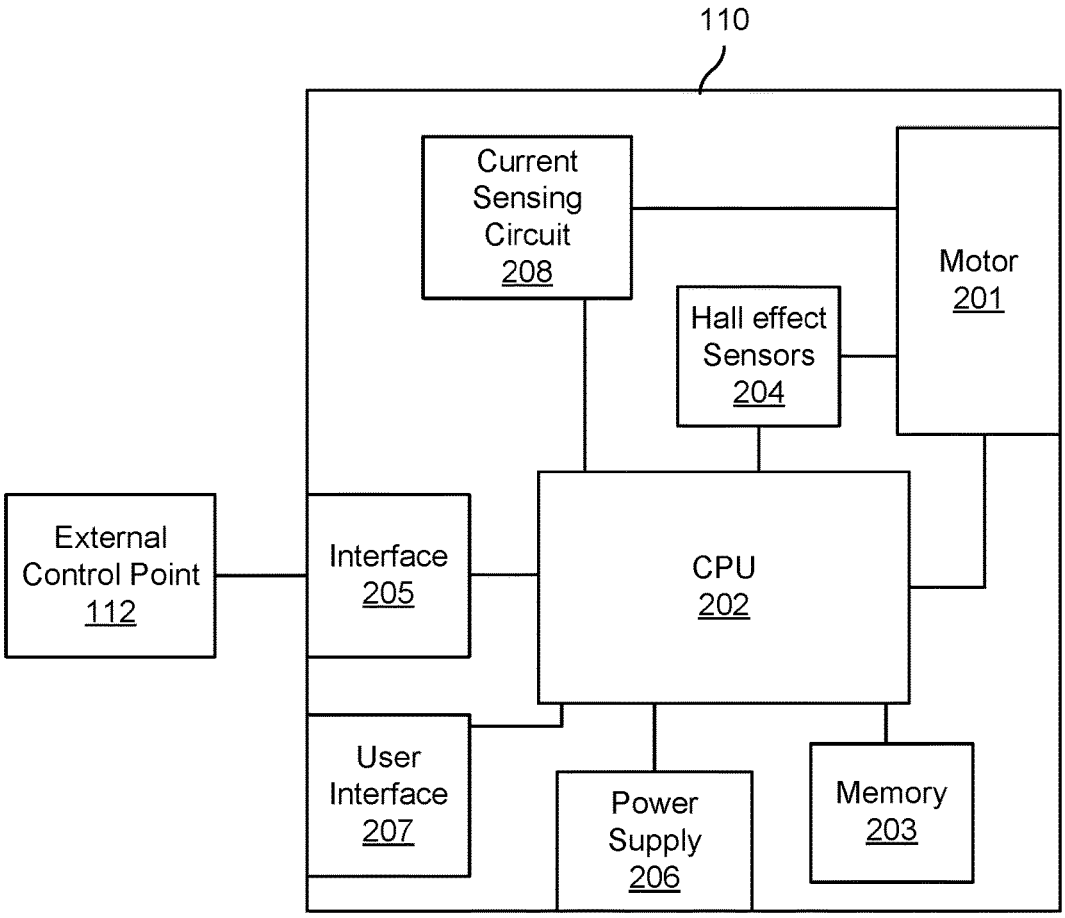

FIG. 2 is an illustrative block diagram of a controller for use in the drapery track assembly according to an illustrative aspect of the embodiments.

Figure 3A:
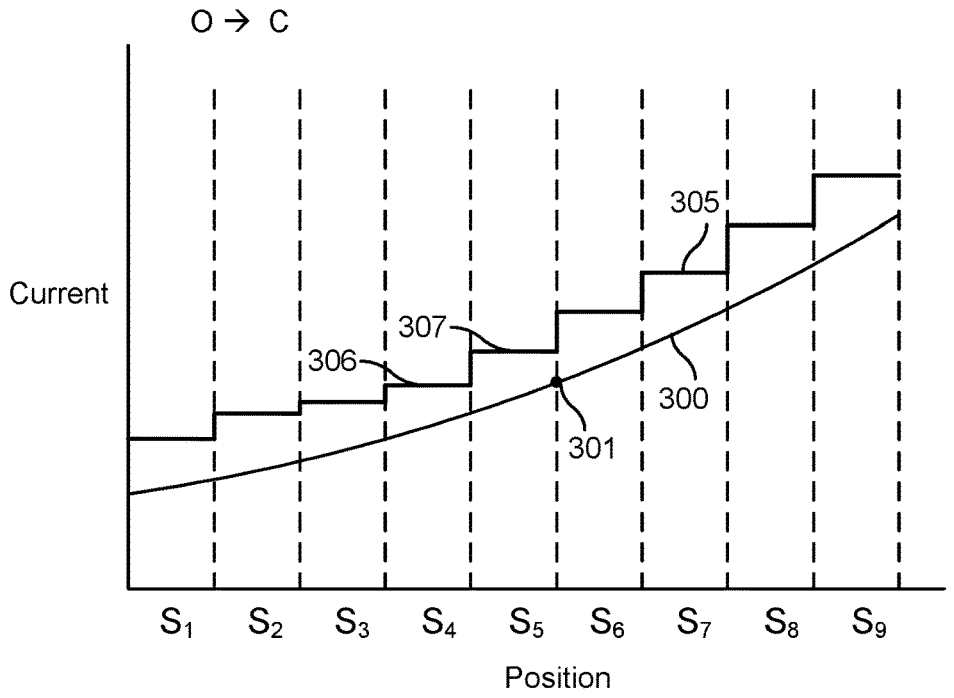

FIG. 3A shows an exemplary diagram illustrating a current curve showing the current drawn by a motor during a normal closing operation of the drape according to an illustrative aspect of the embodiments.

Figure 3B:
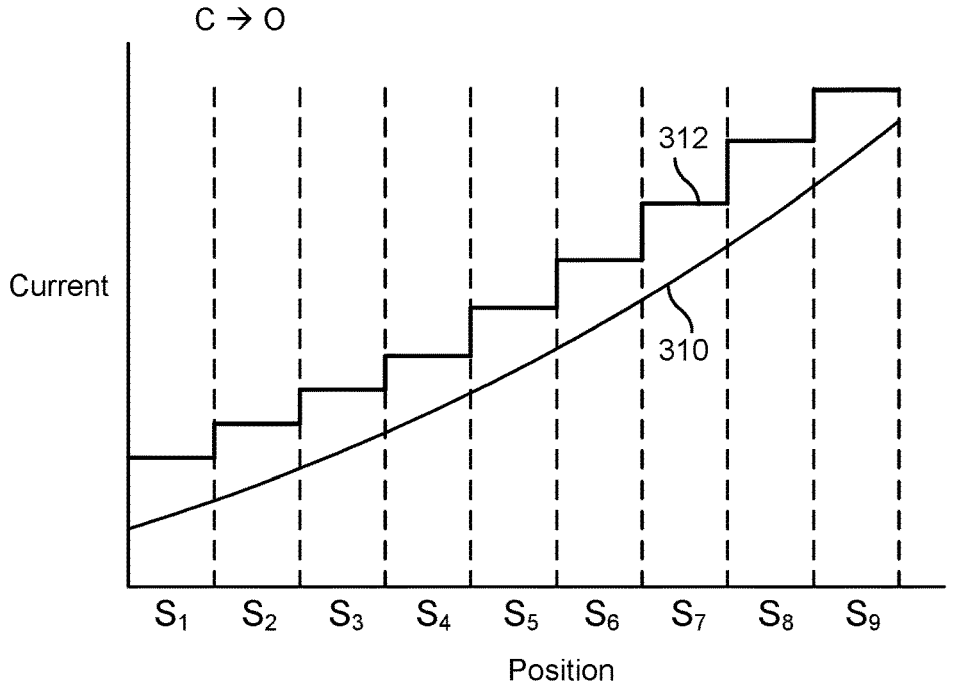

FIG. 3B shows an exemplary diagram illustrating a current curve showing the current drawn by a motor during a normal opening operation of the drape according to an illustrative aspect of the embodiments.

Figure 4:
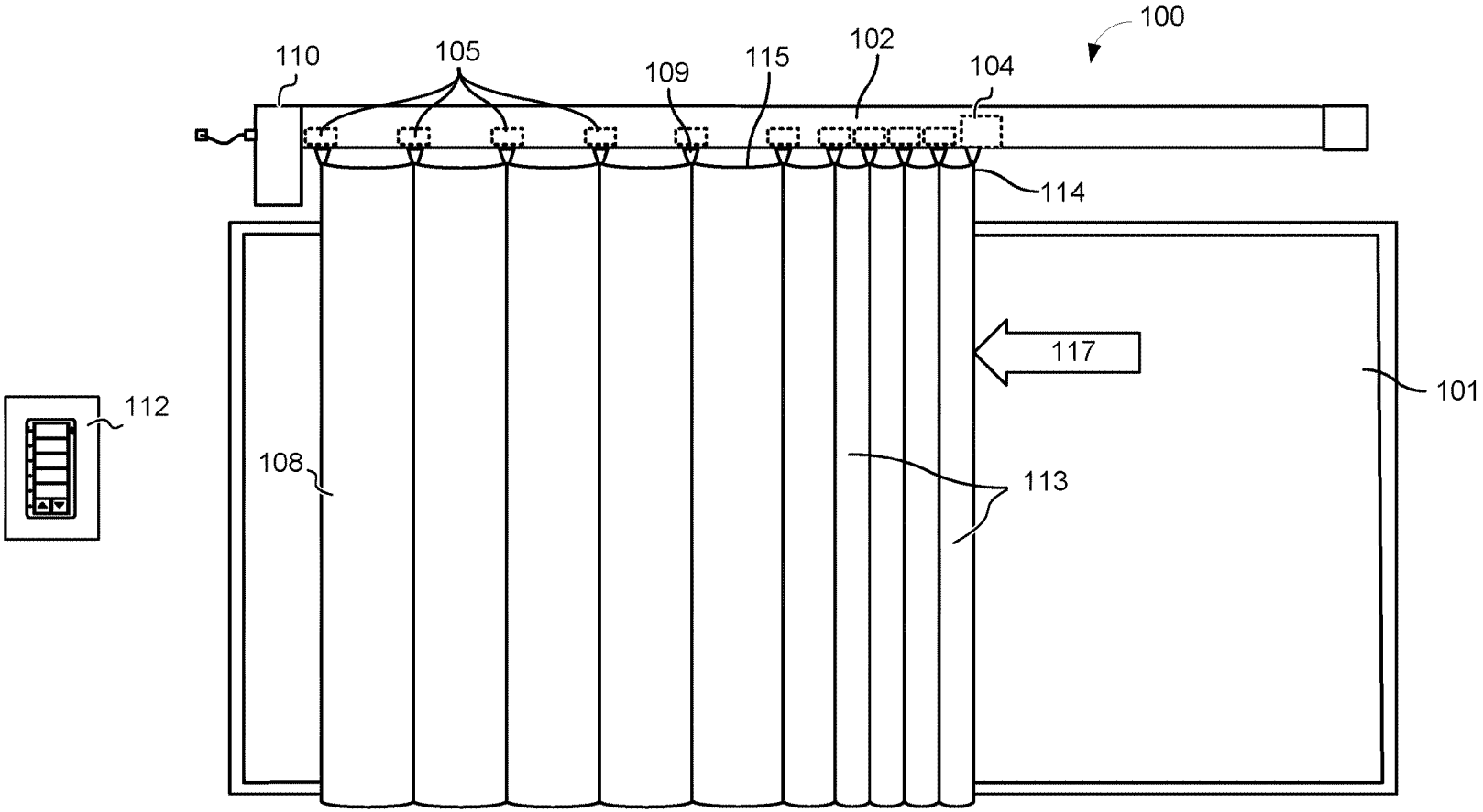

FIG. 4 illustrates an exemplary motorized drapery track assembly traveling in an opening direction according to an illustrative aspect of the embodiments.

Figure 5:
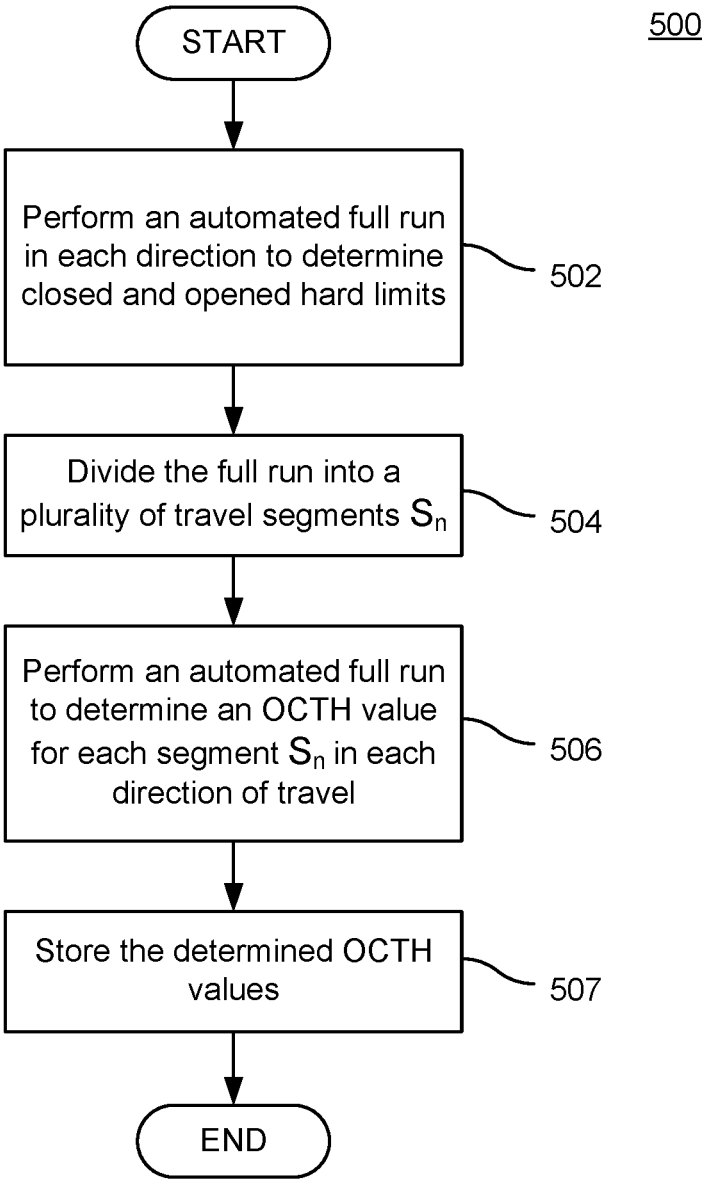

FIG. 5 is a flowchart illustrating the steps for a method of capturing a multi-point OCTH profile in each direction of travel according to an illustrative aspect of the embodiments.

Figure 6:
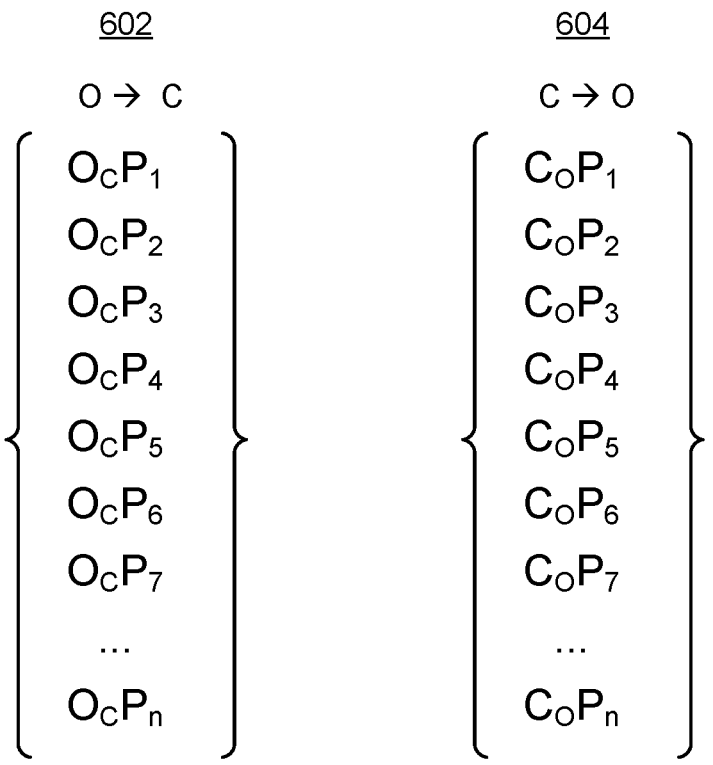

FIG. 6 illustrates an opened to closed vector and a closed to opened vector representing the multi-point OCTH profiles according to an illustrative aspect of the embodiments.

Figure 7:
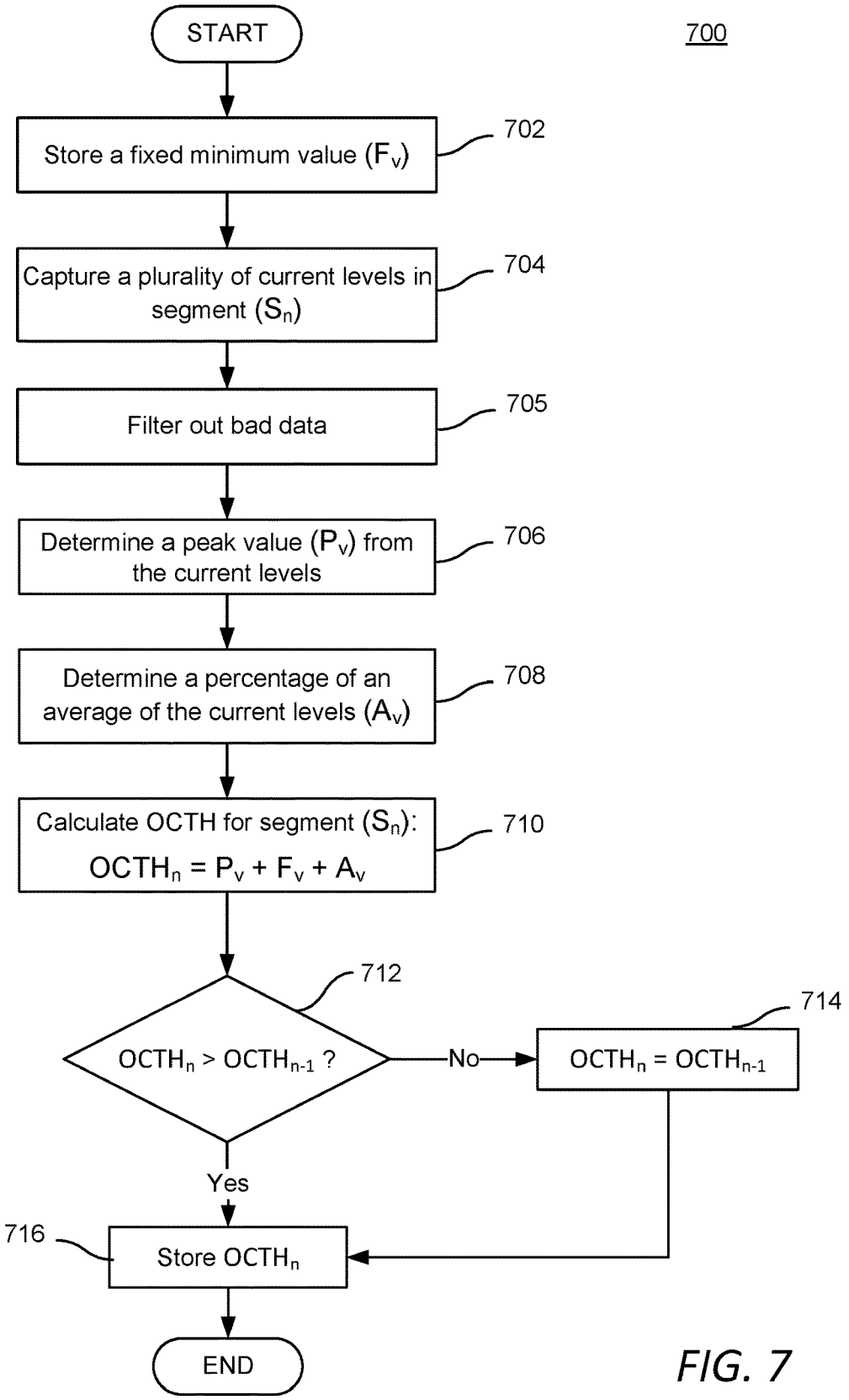

FIG. 7 is a flowchart illustrating the steps for a method of calculating an OCTH value for each segment of travel in each direction according to an illustrative aspect of the embodiments.

Figure 8:
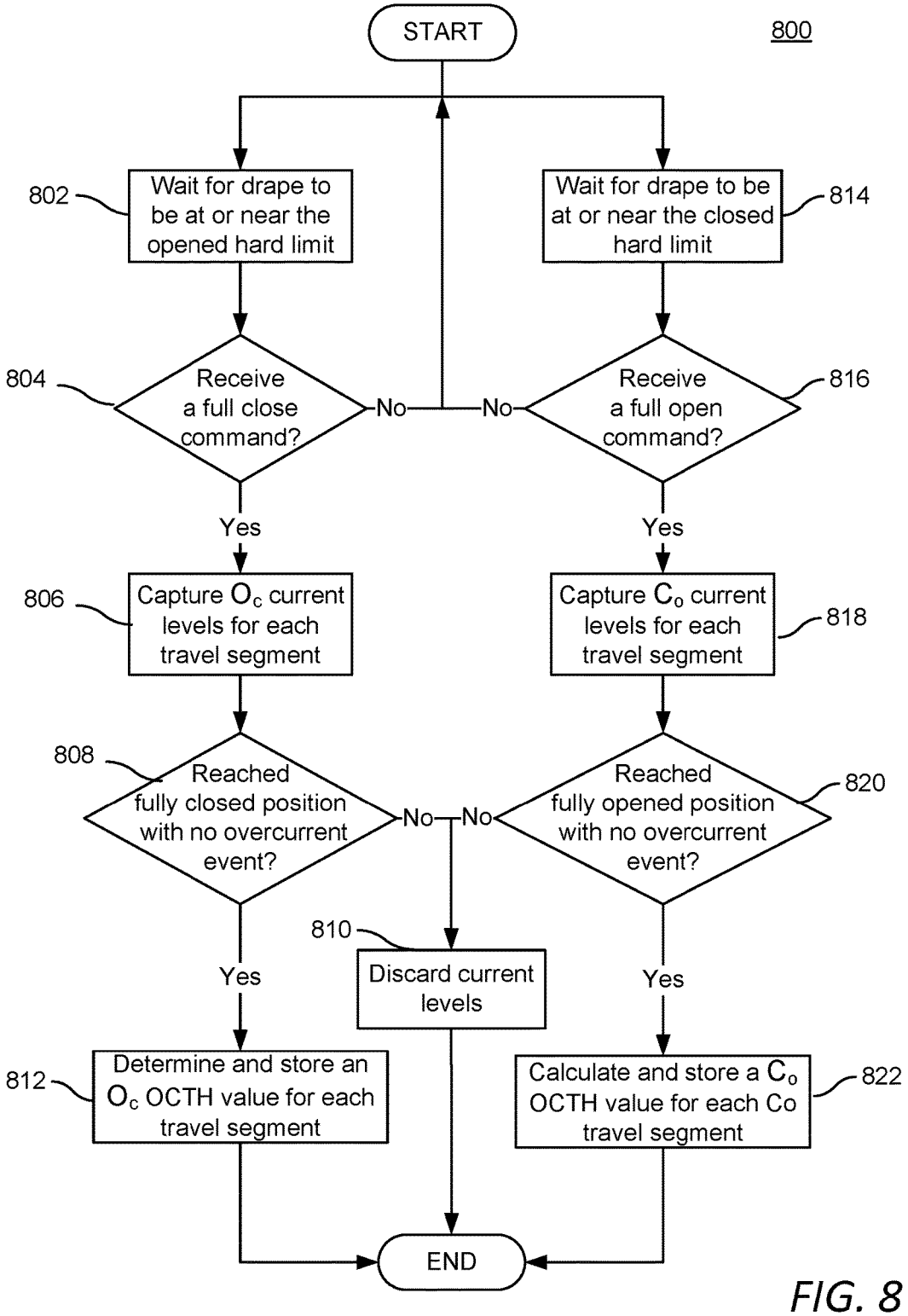

FIG. 8 is a flowchart illustrating the steps for a method of dynamically updating the multi-point OCTH profile per each direction of travel according to an illustrative aspect of the embodiments.

Figure 9:
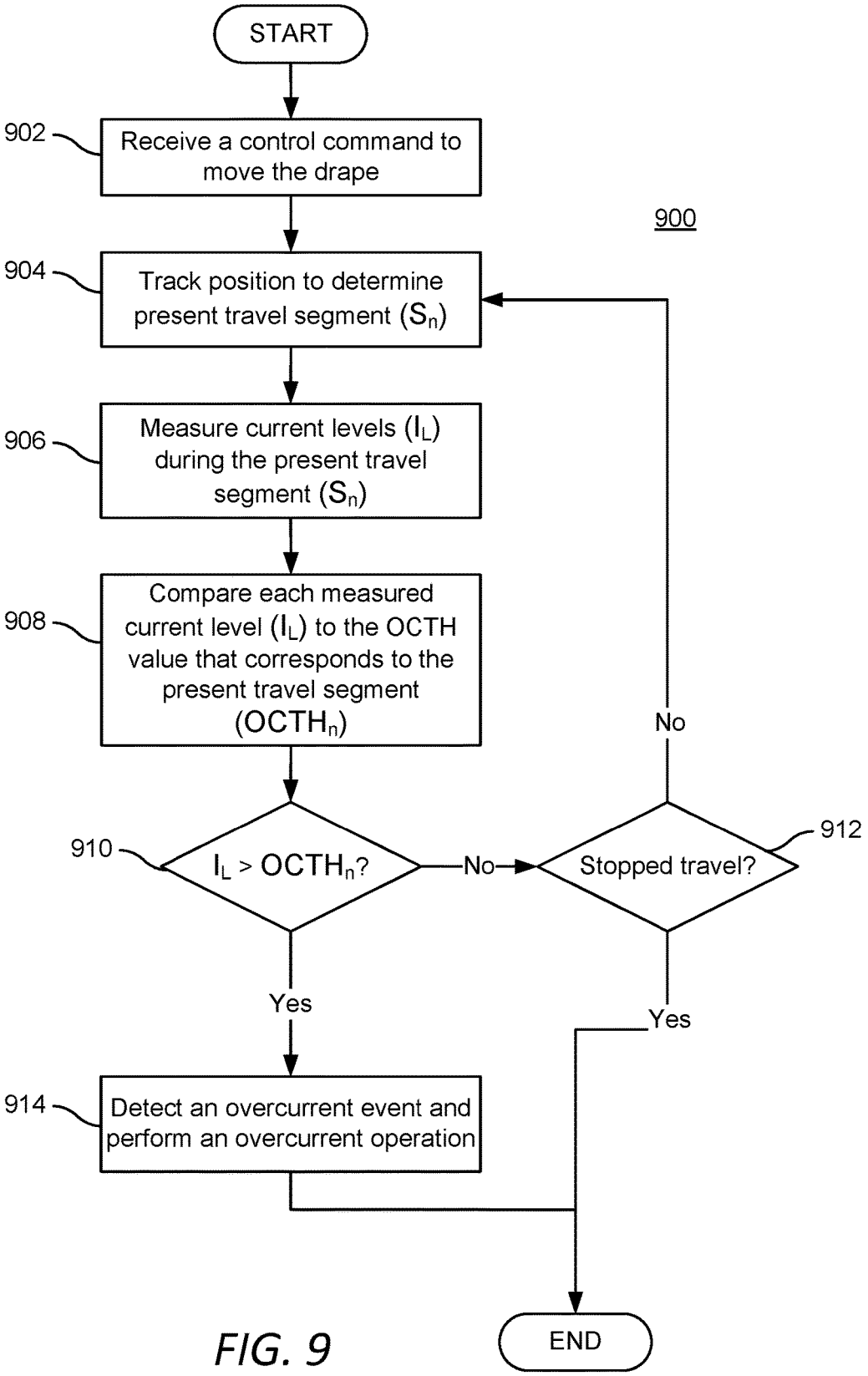

FIG. 9 is a flowchart illustrating the steps for a method of detecting an overcurrent event according to an illustrative aspect of the embodiments.

Figure 10:
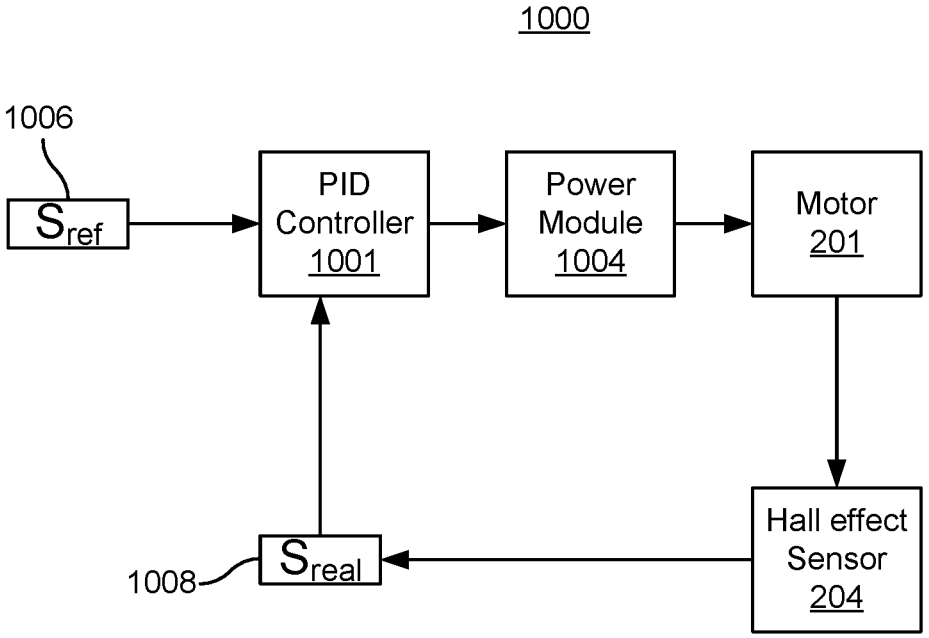

FIG. 10 is an illustrative block diagram of a speed control loop according to an illustrative aspect of the embodiments.

Figure 11:
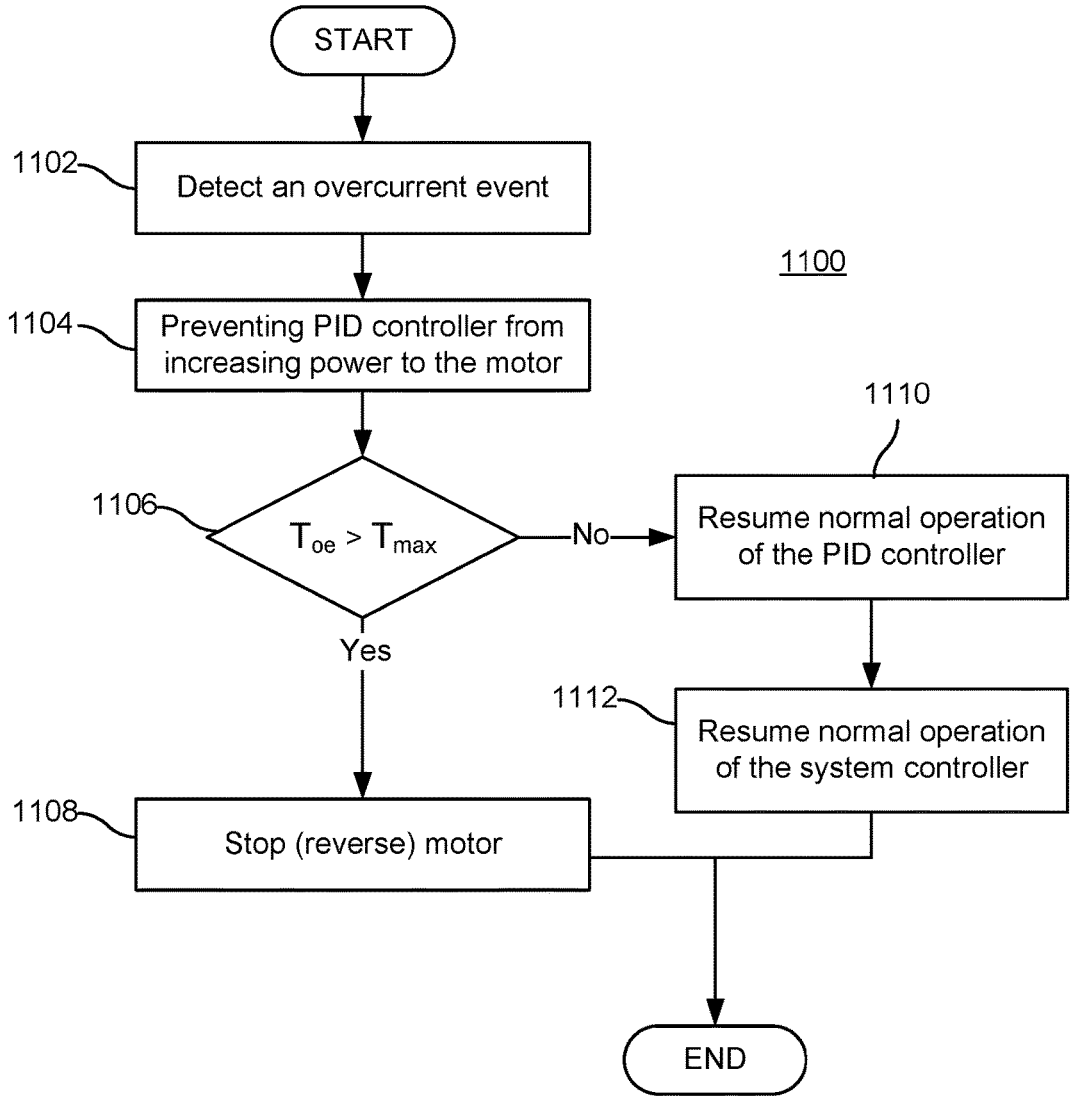

FIG. 11 is a flowchart illustrating the steps for an overcurrent operation according to an illustrative aspect of the embodiments.

Figure 12:
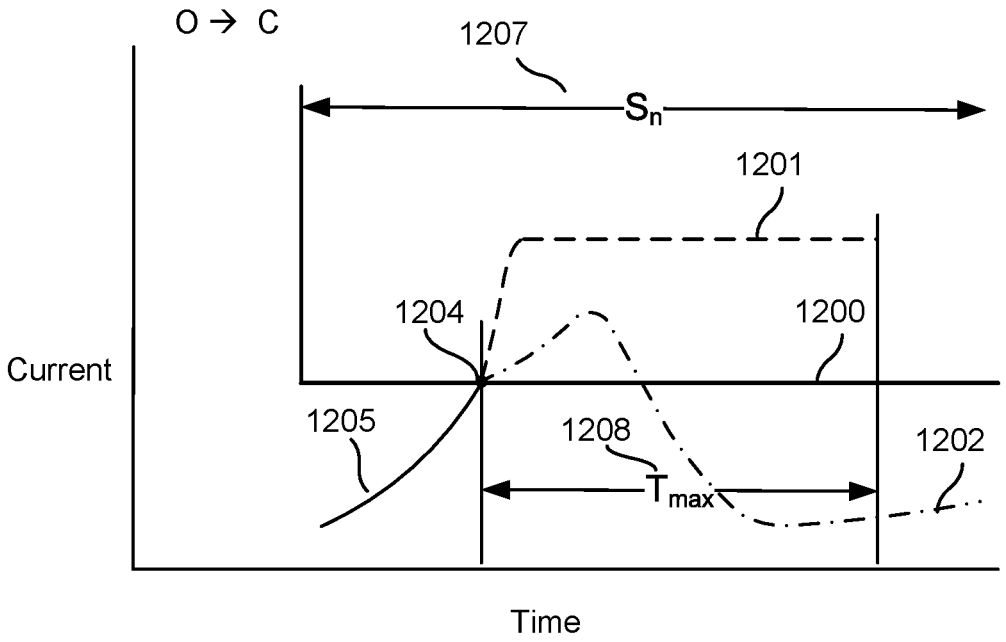

FIG. 12 shows an exemplary diagram illustrating a current curve showing the current drawn by the motor during an overcurrent event according to an illustrative aspect of the embodiments.

DETAILED DESCRIPTION OF THE INVENTION

The embodiments are described more fully hereinafter with reference to the accompanying drawings, in which embodiments of the inventive concept are shown. In the drawings, the size and relative sizes of layers and regions may be exaggerated for clarity. Like numbers refer to like elements throughout. The embodiments may, however, be embodied in many different forms and should not be construed as limited to the embodiments set forth herein. Rather, these embodiments are provided so that this disclosure will be thorough and complete, and will fully convey the scope of the inventive concept to those skilled in the art. The scope of the embodiments is therefore defined by the appended claims. The detailed description that follows is written from the point of view of a control systems company, so it is to be understood that generally the concepts discussed herein are applicable to various subsystems and not limited to only a particular controlled device or class of devices described herein.

Reference throughout the specification to "one embodiment" or "an embodiment" means that a particular feature, structure, or characteristic described in connection with an embodiment is included in at least one embodiment of the embodiments. Thus, the appearance of the phrases "in one embodiment" on "in an embodiment" in various places throughout the specification is not necessarily referring to the same embodiment. Further, the particular feature, structures, or characteristics may be combined in any suitable manner in one or more embodiments.

LIST OF REFERENCE NUMBERS FOR THE ELEMENTS IN THE DRAWINGS IN NUMERICAL ORDER

The following is a list of the major elements in the drawings in numerical order.

100 Drapery Track Assembly
101 Opening
102 Track
104 Master Carrier
105 Auxiliary Carriers
108 Drapery or Drape
109 Drapery Supporting Elements
110 Controller
112 External Control Point
113 Pleats
114 Leading Top Edge
115 Top Edge
116 Closing Direction
117 Opening Direction
201 Motor
202 CPU
203 Memory
204 Hall Effect Sensors
205 Interface
206 Power Supply
207 User Interface
208 Current Sensing Circuit
300 Current Versus Position Curve
301 Current Level/Peak Value ($P_v$)
305 Opened to Closed ($O_C$) Multi-Point OCTH Profile
306 OCTH Value
307 OCTH Value
310 Current Versus Position Curve
312 Closed to Opened ($C_O$) Multi-Point OCTH Profile
500 Flowchart Illustrating the Steps for a Method of Capturing a Multi-Point OCTH Profile in Each Direction of Travel
502-507 Steps of Flowchart 500
602 Opened to Closed Vector
604 Closed to Opened Vector
700 Flowchart Illustrating the Steps for a Method of Calculating an OCTH Value for each Segment of Travel in Each Direction
702-716 Steps of Flowchart 700
800 Flowchart Illustrating the Steps for a Method of Dynamically Calibrating the Drapery Track Assembly to Update Its Multi-Point OCTH Profile Per Each Direction of Travel
802-822 Steps of Flowchart 800
900 Flowchart Illustrating the Steps for a Method of Detecting an Overcurrent Event
902-912 Steps of Flowchart 900
1000 Speed Control Loop
1001 PID Controller
1004 Power Module
1006 Reference Speed
1008 Real Speed
1100 Flowchart Illustrating the Steps for an Overcurrent Operation
1102-1112 Steps of Flowchart 1100
1200 OCTH Value
1201 Current Curve of First Scenario

1202 Current Curve of Second Scenario
1204 Crossover Point
1205 Current Versus Position Curve
1207 Travel Segment
1208 Predetermined Maximum Amount of Time

LIST OF ACRONYMS USED IN THE SPECIFICATION IN ALPHABETICAL ORDER

The following is a list of the acronyms used in the specification in alphabetical order.

AC Alternating Current
ASIC Application Specific Integrated Circuit
$A_v$ Percentage of an Average of Current Levels
CAT5 Category 5
$C_O$ Closed to Opened
CPU Central Processing Unit
DC Direct Current
$F_v$ Predefined Fixed Minimum Value
$I_L$ Current Level
IR Infrared
LAN Local Area Network
LED Light Emitting Diode
mA Milliamps
$O_C$ Opened to Closed
OCTH Overcurrent Threshold
$OCTH_n$ Overcurrent Threshold Value for Travel Segment $S_n$
PID Proportional-Integral-Derivative
PoE Power over Ethernet
$P_v$ Peak Value of Current Levels
RISC Reduced Instruction Set
RAM Random-Access Memory
RF Radio Frequency
ROM Read-Only Memory
$S_n$ Travel Segments
$S_{real}$ Real Speed
$S_{ref}$ Reference Speed
$T_{max}$ Predetermined Maximum Amount of Time
$T_{oe}$ Length of Time of the Overcurrent Event

MODE(S) FOR CARRYING OUT THE INVENTION

For 40 years Crestron Electronics, Inc. has been the world's leading manufacturer of advanced control and automation systems, innovating technology to simplify and enhance modern lifestyles and businesses. Crestron designs, manufactures, and offers for sale integrated solutions to control audio, video, computer, and environmental systems. In addition, the devices and systems offered by Crestron streamlines technology, improving the quality of life in commercial buildings, universities, hotels, hospitals, and homes, among other locations. Accordingly, the systems, methods, and modes of the aspects of the embodiments described herein can be manufactured by Crestron Electronics Inc., located in Rockleigh, N.J.

Aspects of the embodiments relate generally to drapery track systems, and more specifically to systems, methods, and modes for automatic and dynamic torque calibration for a drapery track system to enable automatic detection of pulling of the drape as well as obstacles to minimize damage to the drapery track system or users. While the different aspects of the embodiments described herein pertain to the context of drapery track systems, they are not limited thereto, except as may be set forth expressly in the appended claims. For example, the methods described herein can be used on any type of motorized track systems, such as motorized doors, panels, gates, or the like. The embodiments described herein may be further adapted in other types of motorized window or door treatments, such as motorized roller shades, inverted rollers, Roman shades, Austrian shades, pleated shades, blinds, shutters, skylight shades, garage doors, or the like.

Referring to FIG. 1, there is shown an illustrative diagram of a drapery track assembly 100 for use in either a residential or commercial settings. Drapery track assembly 100 may be mounted to a wall or a ceiling using hardware (not shown) above a window or opening 101. The drapery assembly 100 may include a track 102, a master carrier 104, auxiliary carriers 105, and a controller 110. The drapery track assembly 100 may further comprise one or more drapes 108 comprising fabric or other covering material. Drape assemblies typically fall into one of two categories: single drape assemblies or double drape assemblies. For example, the drapery track assembly 100 may comprise a single drape assembly, as shown in FIG. 1, including a single drape 108. In another embodiment, the drapery track assembly 100 may comprise a double drape assembly that includes two drapes, each covering a portion of an opening. Each drape in a double drape assembly is attached to a master carrier that closes toward and opens away from the center of the opening. The two master carriers may be synchronized to move in unison (i.e. both are opening or both are closing). While the present embodiments are described with reference to a single drape assembly, the techniques described herein may apply to either the single drape assembly, the double drape assembly, or any number of drape assemblies.

Track 102 may comprise a longitudinal body made up of one, two, or several track pieces joined together. Track 102 may comprise a channel disposed therein configured to retain carriers 104 and 105. Carriers 104 and 105 may be held in movable linear mechanical restraint within the channel of track 102 and may comprise wheels (not shown) allowing carriers 104 and 105 to linearly travel within the channel of track 102. Carriers 104 and 105 may comprise drapery supporting elements 109, such as hooks or loops, designed to retain pre-strengthened points or holes along the top edge 115 of the drape 108. Particularly, the master carrier 104 is attached to the leading top edge 114 of the drape 108 and the auxiliary carriers 105 are attached along the remainder top edge 115 of the drape 108 at substantially equal intervals. As a result, the drape 108 comprises vertical pleats 113 between the carriers 104 and 105.

The controller 110 may comprise a motor 201 (FIG. 2) for driving the master carrier 104 along track 102. According to an embodiment, the motor 201 may be configured to spin a shaft in either a clockwise or a counterclockwise direction, depending on the desired direction of travel. The shaft may be connected to a gearing assembly configured to drive a drive belt or a timing belt. The master carrier 104 may be driven by the belt such that rotating the motor 201 in one direction causes the master carrier 104 to linearly move along the length of the track 102 in direction 116 and pull the leading edge 114 of the drape 108 as well as the auxiliary carriers 105 to extend the drape 108 to a closed position. Similarly, rotating the motor 201 in an opposite direction causes the master carrier 104 to linearly move along the length of the track 102 in direction 117 (FIG. 4) and push the leading edge 114 of the drape 108 as well as the auxiliary carriers 105 to retract the drape 108 to an opened position. In one embodiment, the drapery track assembly 100 may comprise similar configuration to the drapery track system shown and disclosed in U.S. patent application Ser. No.

14/479,631, filed Sep. 8, 2014, and titled "Drapery Track System", the entire contents of which are hereby incorporated by reference. In another embodiment, instead of a timing belt, the drapery track assembly 100 may utilize a pulley system, or the like.

To extend and retract the drape 108 to a desired position, the master carrier 104 linearly travels along the length of the track 102 according to a control command signal received by the controller 110. According to an embodiment, the controller 110 may receive control commands from an external control point 112, such as a user interface in a form of a keypad. The user interface 112 may be wired to the controller 110 or may transmit control commands wirelessly to the controller 110. In a further embodiment, the control command may also comprise information pertaining to the desired speed of the master carriers 104. The speed of the master carriers 104 may be varied to account for circumstances or application. In some instances, a smooth non-disruptive motion of the drape 108 is preferred. In other instances, the drape 108 may need to be closed suddenly. This is particularly useful in certain applications such as in a theater where large drapes are opened and closed at various times and speeds for dramatic effect.

FIG. 2 is an illustrative block diagram of a controller 110 for use in the drapery track assembly 100 according to one embodiment. The controller 110 may comprise a motor 201 configured for driving the master carrier 104. According to an embodiment, the motor 201 may be a brushless direct current (DC) motor.

In an embodiment, the controller 110 may further comprise a central processing unit (CPU) 202. CPU 202 can represent one or more microprocessors, and the microprocessors can be "general purpose" microprocessors, a combination of general and special purpose microprocessors, or application specific integrated circuits (ASICs). Additionally, or alternatively, the CPU 202 can include one or more reduced instruction set (RISC) processors, video processors, or related chip sets. The CPU 202 can provide processing capability to execute an operating system, run various applications, and/or provide processing for one or more of the techniques and functions described herein. For example, the CPU 202 can process various commands and perform operations, such as controlling the direction, position, and speed of the motor 201 in response to receiving desired position commands from the external control point 112.

According to an embodiment, the CPU 202 may comprise two microcontrollers. A first microcontroller may be designated as the master microcontroller that handles network traffic, external user interface, application logic, and will keep high level view of the motion state. A second microcontroller may be a slave microcontroller that communicates with the master microcontroller and handles controlling the motor 201 with Hall Effect sensors feedback, as will be described below. This second microcontroller may keep a low level motion state and perform dedicated tasks, such as motor position tracking, motor communication control, current intensity feedback, overcurrent monitoring by constantly reading the hall effect sensor in real time, or the like. However, a single or any number of microcontrollers may be utilized.

The controller 110 can further include a memory 203 communicably coupled to the CPU 202. The memory 203 may store information accessible by CPU 202, including instructions for execution by the processor 202. The memory 203 can represent nonvolatile memory, such as read-only memory (ROM) or Flash memory, or can also include volatile memory such as random-access memory (RAM). In buffering or caching data related to operations of the CPU 202, memory 203 can store data associated with applications running on the control processor 202.

The controller 110 may comprise a power supply 206 configured for providing power to the various components of the controller 110. The power supply 206 may be connected to a voltage line for receiving an electric alternating current (AC) power signal from an AC mains power source. The power supply 206 may comprise circuit components configured for converting the incoming AC power signal to a direct current (DC) power signal. In another embodiment, the controller 110 may be connected to an external power supply for receiving a DC power signal.

In an embodiment, the controller 110 may comprise a user interface 207, such one or more buttons, configured for enabling configuration of the drapery track assembly 100 as well as receiving position control commands directly from a user. The user interface 207 may further comprise one or more light indicators, such as light emitting diodes (LED), to provide feedback to the status of the drapery.

In another embodiment, the controller 110 further comprises an interface 205, such as a wired or a wireless interface, configured for receiving control commands from an external control point 112. The wireless interface may be configured for bidirectional wireless communication with other electronic devices, such as the external control point 112, over a wireless network. The wireless network interface may comprise a radio frequency (RF) transceiver configured for bidirectional wireless communication using wireless communication protocols, such as the ZigBee® protocol, the infiNET EX® protocol from Crestron Electronics, Inc. of Rockleigh, N.J., or the like. In another embodiment, the wireless interface may in addition or alternately comprise an infrared (IR) interface.

The control commands received by the controller 110 may be a direct user input to the controller 110 from the user interface 207 or a wired or wireless signal from an external control point 112. For example, the controller 110 may receive a control command from a wall-mounted button panel or a touch-panel in response to a button actuation or similar action by the user. Control commands may also originate from a signal generator such as a timer or a sensor. In an embodiment, a timer may be configured for transmitting a control input to the controller 110 at a predetermined time. The timer may be set according to personal preferences or for security reasons. In another embodiment, a light sensor may be configured for transmitting a control input to the controller 110 in response to sensing a predetermined level of sunlight.

In various aspects of the embodiments, the interface 205 and/or power supply 206 can comprise a Power over Ethernet (PoE) interface. The controller 110 can receive both the electric power signal and the control input from a network through the PoE interface. For example, the PoE interface may be connected through category 5 cable (CAT5) to a local area network (LAN) which contains both a power supply and multiple control points and signal generators. Additionally, through the PoE interface, the controller 110 may interface with the internet and receive control inputs remotely, such as from a homeowner running an application on a smart phone.

The controller 110 may further comprise one or more Hall effect sensors 204 connected to the motor 201 and configured for determining the direction, speed, and position of the motor's shaft. Each Hall effect sensor 204 may comprise a transducer that varies its output voltage in response to a magnetic field. The CPU 202 may employ the information provided by the Hall effect sensors 204 as a feedback for control of the motor 201.

The controller 110 further comprises a current sensing circuit 208 configured for sensing the current drawn by the motor 201. According to an embodiment, the current sensing circuit 208 may comprise a current sense resistor and an amplifier along with a low pass filter. However, other type of current sensing components may be utilized. For example, the current sensing circuit 208 may comprise a Hall effect sensor for measuring current levels. The CPU 202 may employ the information provided by current sensing circuit 208 as a feedback for control of the motor 201.

The present embodiments pertain to systems, methods, and modes for providing a drapery track assembly 100 that detects pulling of the drape as well as obstacles and in response controls its movement via an automatic and dynamic torque calibration method. Particularly, the controller 110 calculates a dynamic multi-point overcurrent threshold (OCTH) profile in each direction of travel during a normal operation run, as will be described below, and uses that profile during normal operation to detect obstacles. Each multi-point OCTH profile represents changes in the normal operating torque during the drape's 108 travel along track 102. The multi-point OCTH profile may be configured to cause the motor 201 to stop and possibly backup if the controller 110 encounters a torque higher than expected for its normal operation. The high torque may be indicated by the current sensing circuit 208, which may detect an excessive current draw when the drape 108 is pulled or when it encounters an obstacle, such as a jam of the drapery fabric, or other excessive load.

Beneficially, this multi-point OCTH profile is dynamically determined based on the individual drapery track assembly's normal operation. As such, the threshold value is not set arbitrarily to a single static high value at the factory, which can result in damage to the drapery track assembly in the field. There are good reasons not to set a single large value at the factory. Such a value would not represent the normal operating torque of the drapery track assembly when it is finally installed. There are a number of factors that can change the amount of torque required based on the installation. For example, the torque required to open and close a drapery track assembly 100 will vary depending on various factors, such as the drapery track's 102 length and shape (for example, if it is curved), the thickness, length, width and weight of the drapery 108 pulled by the motor 201, the addition of hardware, such as channels, that could add friction to the drape 108, among a variety of other factors. Depending on the opening's 101 size and the fabric selection, the torque required to open and close the drape 108 will change.

Additionally, the torque required to open or close the drape 108 changes as the drape 108 travels along track 102. This is because the load exerted by the drape 108 changes during travel. Referring to FIG. 1, during closing of the drape 108, initially the exerted load is small because the master carrier 104 starts pulling and extending only the first pleat 113 of the drape 108. But as the master carrier 104 continues to travel, it starts to pull the auxiliary carriers 105 one by one and progressively starts to pull more of the drapery fabric 108. Additionally, each one of the auxiliary carriers 105 has friction as it moves. Separating each one of the auxiliary carriers 105 and then pulling them adds to the load. Therefore, the torque required to close the drape 108 gradually increases during the drape's travel. FIG. 3A shows an exemplary diagram illustrating a current versus position curve 300 showing the current drawn by the motor 201 during a normal closing operation of the drape 108 during a full run (i.e., from a fully opened position to a fully closed position). As illustrated, the current drawn on the motor 201 gradually increases as the drape 108 travels along track 102 from an opened position to a closed position. As such setting a single threshold value that is above the peak current value of curve 300 would be ineffective to detect fluctuation in current levels at the beginning of the drape's travel. The drape 108 may encounter an object, or be pulled, at the beginning of the travel, but the controller 110 would not react to such force, potentially causing tearing of the fabric. Accordingly, instead of determining a single OCTH value, an opened to closed ($O_c$) multi-point OCTH profile 305 (FIG. 3A) is determined comprising a plurality of OCTH values for each segment of travel that change over the drape's travel.

Moreover, the torque required to open the drape 108 is different from the torque required to close the drape 108. Referring to FIG. 4, during opening of the drape 108, the master carrier 104 does not pull the drapery fabric 108 and auxiliary carriers 105, but instead pushes the drapery fabric 108 and auxiliary carriers 105. The amount of friction differs in the opening direction because of how the carriers 105 react as they are being pushed rather than being pulled. Initially, less torque is required to push the fabric 108 to an opened position. However, as the fabric 108 begins to bunch up at the end of the travel, the required torque increases. Typically, during the opening operation, the current tends to raise faster toward the end of the travel due to the bunching of the fabric, resulting in a steeper curve. As such, the current versus position curves 300 and 310 are different in each direction of travel. FIG. 3B shows an exemplary diagram illustrating a gradually increasing current versus position curve 310 showing the current drawn by the motor 201 during a normal opening operation of the drape 108 during a full run (i.e., from a fully closed position to a fully opened position). Accordingly, a separate multi-point OCTH profile with different OCTH values is determined for each direction of travel, including an opened to closed ($O_c$) multi-point OCTH profile 305 and a closed to opened ($C_o$) multi-point OCTH profile 312.

According to the present embodiments, these multi-point OCTH profiles are not preset, but are dynamically determined for each individual drapery track assembly during its operation. According to one embodiment, the motor 201 can be calibrated by determining new multi-point OCTH profiles upon the drapery track assembly's 100 installation in the field during first operation. Initially, the controller 110 may be programmed to have default multi-point OCTH profiles with zero OCTH values. After determining new multi-point OCTH profiles after installation, these multi-point OCTH profiles may be stored on memory 203. According to yet another embodiment, the motor 201 can be calibrated to determine the multi-point OCTH profiles during the manufacturing process. After the drapery track assembly 100 is completely manufactured to size, it may be inspected on a test rack to determine the multi-point OCTH profiles. According to a further embodiment, after each power up of the drapery track assembly 100, the memory 203 is reset and new multi-point OCTH profiles can be determined to ensure proper operation. Additionally, the multi-point OCTH profiles can be dynamically updated during the continual normal operation of the drapery track assembly 100, as is described below.

FIG. 5 is a flowchart 500 illustrating the steps for a method of capturing a multi-point OCTH profile in each direction of travel, according to one embodiment. The method shown in FIG. 5 may be performed during configuration of the drapery track assembly 100 after installation, on a fully assembled drapery track assembly 100 at the factory, after each power up of the controller 110, upon receipt of a command to perform auto calibration through the user interface 207 of the controller 110, in response to a reset command received from a user, in the event the speed of the drapery track assembly 100 has been changed (e.g., set to a higher value), if the closed or opened hard limits have been changed, or the like. In response to any such occurrence, the already stored OCTH values of the multi-point OCTH profiles may be cleared to zero and may be recalibrated.

Initially, in step 502, the drapery track assembly 100 may perform an automated full run in each direction of travel to automatically determine closed and opened hard limits. During that step, the controller 110 may control the motor 201 to move the drapery 108 to a fully closed position until the master carrier 104 reaches a closed physical hard limit. The controller 110 will save that position, as determined by the Hall effect sensor 204, as the "Close Hard Limit" in memory 203. Then the controller 110 may control the motor 201 to move the drapery 108 to a fully opened position until the master carrier 104 reaches an opened physical hard limit. The controller 110 will save that position, as determined by the Hall effect sensor 204, as the "Open Hard Limit" in memory 203. These values can be used as position references to track the position of the drapery 108 along the track 102. Small tolerances may be added to these values, for example to account for possible spring back from the fabric. According to another embodiment, these hard limits may be predetermined at the factory.

After the hard limits have been set, the controller 110 will divide the full run into a plurality of linear travel segments ($S_n$) in step 504. The positions of these travel segments ($S_n$) may be stored in memory 203. For example, as shown in FIGS. 3A and 3B, the controller 110 may divide the full run into nine substantially equal travel segments $S_1$ through $S_9$. However, any number of segments ($S_n$) can be chosen as long as sufficient number of data points can be captured for each segment to ensure that a proper behavior can be recorded during a normal run of the drapery track assembly 100. For example, at least 10 data points per 100 milliseconds produce a sufficient data point sample.

Then, in step 506, the drapery track assembly 100 will perform an automated full run in each direction to determine an OCTH value for each travel segment ($S_n$) in each direction of travel to build the multi-point OCTH profiles. As such, each segment of travel ($S_n$) in each direction will comprise its own OCTH value. For example, for nine segments, the drapery track assembly 100 will determine nine OCTH values for opened to closed $O_C$ travel and nine OCTH values for closed to opened $C_O$ travel. These OCTH values may be stored on memory 203 of the controller 110 in step 507. According to an embodiment, these OCTH values for each direction of travel may be stored in memory 203 as two vectors. FIG. 6 illustrates an opened to closed vector 602 containing $O_CP_1$ through $O_CP_n$ OCTH values representing the opened to closed ($O_C$) multi-point OCTH profile. FIG. 6 also illustrates a closed to opened vector 604 containing $C_OP_1$ through $C_OP_n$ OCTH values representing the closed to opened ($C_O$) multi-point OCTH profile. These OCTH values will be used as threshold values to detect pulling of the drape as well as obstacles during travel of the drape 108, as described below.

FIG. 7 is a flowchart 700 that illustrates a method of calculating an OCTH value for each segment of travel ($S_n$) in each direction according to one embodiment. Each OCTH value is calculated per segment of travel ($S_n$) based on the detected load, as determined by the current drawn on the motor 201, while running normal operation. Particularly, in step 702, a predefined fixed minimum value ($F_v$) is stored in memory 203 of the controller 110. For example, this fixed minimum value ($F_v$) may comprise a value of about 240 milliamps (mA). Then in step 704, as the master carrier 104 travels within the segment of travel ($S_n$), the controller 110 captures a plurality of current levels or current draw values from the motor 201 while in motion. As such, during the drape's travel, the controller 110 will record the instantaneous torque being generated at various points. In step 705, the controller 110 may filter out bad data, for example, when the read current level is zero or exceeds an allowable current level range stored in memory 203. For example, while the OCTH values may be calibrated down, this has to be done in a weighted fashion to avoid calibrating down too far due to an anomaly. As such, a current level measurement may be discarded if the drape 108 has overrun the motor 201, indicating that a user may be manually pulling the drape.

In step 706, the controller 110 determines a peak value ($P_v$) from the plurality of captured current levels, which is the greatest measured current value. Generally, this peak value ($P_v$) is the last current draw value or close to the last current draw value recorded for the travel segment. For example, referring to FIG. 3A, current level 301 will be set as the peak value ($P_v$) for travel segment $S_5$.

In step 708, the controller 110 will determine a percentage of an average of the captured current levels ($A_v$). Particularly, the controller 110 will calculate an average of the captured current levels for travel segment ($S_n$) and then calculate a percentage of that average. The percentage may be a predetermined percentage value, which may be about 5% to about 25%, stored in memory 203. For example, the percentage may be 20% of the average of the captured current levels for travel segment ($S_n$).

In step 710, the controller 110 will calculate the OCTH value for the segment of travel ($S_n$). For example, the OCTH value may be calculated using the following formula:

$$OCTH_n = P_V + F_V + A_V \qquad \text{Formula 1}$$

where, $OCTH_n$ is the OCTH value for travel segment ($S_n$);

$P_v$ is the peak value;

$F_v$ is the fixed minimum value; and $A_v$ is the percentage of an average of the current levels.

Accordingly, the OCTH value for segment of travel ($S_n$) will be set somewhat above the top peak of the measured current level for that segment ($S_n$). For example, referring to FIG. 3A, 307 represents the open to close OCTH value for travel segment $S_5$, which is above the peak value ($P_v$) 301 for travel segment $S_5$.

According to an embodiment, in step 712, the calculated OCTH value for travel segment ($S_n$) is compared to an OCTH value recorded for the preceding travel segment or $OCTH_{n-1}$. Referring to FIGS. 3A-3B, the majority of the time during normal operation of a drapery track assembly 100 the current curves 300 and 310 gradually increase during travel. While they may be flat at certain regions, there will generally not going to be decreasing dips in the current curves 300 and 310. As such, typically, the current level of a segment of travel should be higher than the current level of the previous segment of travel. To ensure this predictable behavior of how the system normally operates, if the calculated $OCTH_n$ value for the segment of travel ($S_n$) is higher than the OCTH value recorded for the previous segment or $OCTH_{n-1}$, as is expected, that calculated $OCTH_n$ value is stored in step 716 on memory 203. For example, referring to FIG. 3A, the calculated OCTH value 307 for segment $S_5$ is higher than the calculated OCTH value 306 for segment $S_4$. However, if the calculated $OCTH_n$ value for the segment of travel ($S_n$) is smaller than the OCTH value recorded for the previous segment or $OCTH_{n-1}$, indicating an abnormal behavior, then in step 714 that calculated $OCTH_n$ value is discarded and instead the $OCTH_n$ for segment of travel ($S_n$) is set to the OCTH value recorded for the previous segment ($OCTH_{n-1}$) and stored in step 716.

Referring to FIG. 3A, line 305 represents the opened to closed ($O_C$) multi-point OCTH profile in a form of a step curve illustrating exemplary OCTH values (e.g., 306 and 307) determined for the current level curve 300 during normal closing operation of the drapery track assembly 100. Similarly, referring to FIG. 3B, line 312 represents the closed to opened ($C_O$) multi-point OCTH profile in a form of a step curve illustrating exemplary OCTH values determined for the current level curve 310 during normal opening operation of the drapery track assembly 100. These OCTH values will be used for detection of pulling of the drape as well as detection of obstacles during operation of the drapery track assembly 100 as will be described below. As described above, these OCTH values are dynamic and may be reset and recalculated upon the occurrence of various events, i.e., as the current versus position curves 300 and 310 change.

According to an embodiment, the multi-point OCTH profiles may be dynamically updated during the operation of the drapery track assembly 100 to compensate for any changes to the current curves 300 and/or 310 due to external factors. These external factors may include temperature, humidity, grease viscosity changes, mechanical component wearing, or the like. Additionally, the OCTH values may be calibrated down to prevent anomalies from previously biasing the OCTH values too high. As discussed above, this is done in a weighted fashion. As such, the drapery track assembly 100 may continuously calibrate and update itself to detect excess torque. According to an embodiment, a multi-point OCTH profile in a direction of travel may be calibrated any time the drape 108 travels uninterruptedly in that direction of travel during normal operation of the drapery track assembly 100, as described below. As such, during normal operation of the drapery track assembly 100 only one of the multi-point OCTH profiles will be typically calibrated in only one direction of travel at a time.

FIG. 8 is a flowchart 800 that illustrates a method of dynamically calibrating the drapery track assembly 100 to update its multi-point OCTH profile per each direction of travel, according to one embodiment. To ensure accurate results, the multi-point OCTH profile may be recalibrated only when the drape 108 travels substantially through a full run along track 102—from very near the open hard limit to very near the closed hard limit, and vice versa. For example, when the drape 108 starts traveling from the middle of the track 102, a new multi-point OCTH profile is not calibrated because this may produce unreliable OCTH values. The opened to closed ($O_C$) multi-point OCTH profile may be recalibrated only when the drape 108 starts traveling to the fully closed position from a fully opened position or from a position very near to the fully opened position. Similarly, the closed to opened ($C_O$) multi-point OCTH profile may be recalibrated only when the drape 108 starts traveling to the fully opened position from a fully closed position or from a position very near to the fully closed position.

As such, in steps 802 and 814, the controller 110 waits until the drape 108 is at or near the opened hard limit or until the drape 108 is at or near the closed hard limit. For example, the controller 110 may determine that the drape 108 is near the closed or opened hard limit when the master carrier 104 is positioned within about 10% of that hard limit. If the drape 108 is at or near the opened hard limit, as determined in step 802, the controller 110 waits to receive a full close control command in step 804, for example from a user interface 207 on the controller 110 or from an external control point 112. If the controller 110 receives a control command to just move the drape 108, for example from a button press, the controller 110 will not initiate calibrating the multi-point OCTH profile. The full close control command will indicate to the controller 110 to close the drape 108 to the "Close Hard Limit" stored in memory 203. If the controller 110 does not receive a full close control command, then the controller 110 will not initiate updating the opened to closed ($O_c$) multi-point OCTH profile and will resume to wait for the drape 108 to be at or near the opened or closed hard limits. If the controller 110 does receive a full close control command in step 804, then the controller 110 will initiate data capture to calibrate the opened to closed ($O_c$) multi-point OCTH profile. Particularly, in step 806, the controller 110 will capture the opened to closed ($O_c$) current levels for each travel segment as the master carrier 104 travels along track 102. If the drape 108 reaches fully closed position with no overcurrent event, as determined in step 808, then in step 812 the controller 110 will determine and store an opened to closed ($O_c$) OCTH value for each segment during the drapery's travel (per method disclosed in FIG. 7) to replace the old OCTH values for that direction of travel. However, if during the travel the controller 110 detects an overcurrent event in step 808, as will be described below, the controller 110 will disregard the captured current levels in step 810.

Similarly, if the drape 108 is at or near the closed hard limit as determined in step 814, the controller 110 waits to receive a full open control command in step 816. The full open control command will indicate to the controller 110 to open the drape 108 to the "Open Hard Limit" stored in memory 203. If the controller 110 does not receive a full open control command, then the controller 110 will not initiate updating the closed to opened ($C_o$) multi-point OCTH profile and will resume to wait for the drape 108 to be at or near the opened or closed hard limits. If the controller 110 does receive a full open control command in step 816, then the controller 110 will initiate data capture to calibrate the closed to opened ($C_o$) multi-point OCTH profile. Particularly, in step 818, the controller 110 will capture the closed to opened ($C_o$) current levels for each travel segment as the master carrier 104 travels along track 102. If the drape 108 reaches fully opened position with no overcurrent event, as determined in step 820, then in step 822 the controller 110 will determine and store a closed to opened ($C_o$) OCTH value for each travel segment during the drapery's travel (per method disclosed in FIG. 7) to replace the old OCTH values for that direction of travel. However, if during the travel the controller 110 detects an overcurrent event in step 820, the controller 110 will disregard the captured current levels in step 810.

According to yet another embodiment, the multi-point OCTH profile may be recalibrated during partial runs of the drape 108 along track 102—not only through substantially full runs. In such implementation, instead of updating the entire multi-point OCTH profile, only the OCTH values that correspond to the traveled travel segments will be updated. As such, referring to FIG. 8, in such an implementation steps 802 and 814, as well as steps 804 and 816 may be discarded. According to an embodiment, the OCTH values may be modified if the change in the OCTH value is below a predetermined fixed percentage value to avoid updating to high OCTH values that resulted due to obstacles or friction.

According to an embodiment, the controller 110 of the drapery track assembly 100 uses the determined multi-point OCTH profiles to detect obstacles during operation. When the controller 110 detects that an obstacle has impeded the motion of the drape 108, the controller 110 may enter into an error mode and perform an overcurrent operation. For example, the controller 110 may cause the drape 108 to stop and go in an opposite direction for a very short amount of travel. Any new control command that moves the drape 108 may clear the obstacle error.

According to another embodiment, the drapery track assembly 100 may comprise a touch reaction feature by which the determined multi-point OCTH profiles may also be used to automatically detect pulling on the drape 108. According to an embodiment, the controller 110 may be configured to detect when a user pulls or tugs on the fabric 108 and react to the pulls and tugs on the fabric 108. For example, when the drape 108 is stationary, the may pull on the drape 108 in a desired direction of travel to indicate to the controller 110 to fully open or close the drape 108 in the chosen direction of travel. The user may then subsequently pull again on the drape 108 as it travels to stop the drape 108 from further travel. The multi-point OCTH profiles may be used to detect the user pulling on the drape to enable this touch reaction feature. Particularly, the pull sensitivity of this touch reaction feature may be defined by the determined multi-point OCTH profiles.

FIG. 9 is a flowchart 900 that illustrates a method of detecting an overcurrent event by the controller 110 of the drapery track assembly 100 according to one embodiment. In step 902, the controller 110 may receive a control command to move the drape 108. In step 904, the controller 110 will track the drape's position to determine the present travel segment ($S_n$). In step 906, as the drape 108 travels within the present travel segment ($S_n$), the controller 110 will measure the encountered load, or current levels ($I_L$), during the travel segment ($S_n$). In step 908, the controller 110 will compare each measured current level ($I_L$) to the OCTH value that corresponds to the present travel segment ($OCTH_n$). Beneficially, a different OCTH value will be used as the drape 108 travels from one travel segment to another. If the determined current level ($I_L$) is below the OCTH value that corresponds to the present travel segment ($OCTH_n$), as determined in step 910, then the controller 110 will determine whether the drape 108 has stopped traveling in step 912, whether via receiving a stop command or via reaching a fully closed or fully opened position. If the drape 108 has stopped traveling, then the operation will end. If the drape 108 continues to travel, the controller 110 will proceed to step 904 to track position, measure current levels, and compare them to the OCTH values.

On the other hand, if in step 910 the determined current level ($I_L$) exceeds the OCTH value that corresponds to the present travel segment ($OCTH_n$), then in step 914 the controller 110 will detect an overcurrent event and perform an overcurrent operation. As such, if the current torque being generated exceeds the OCTH value, it is presumed that the drape 108 has become obstructed.

For example, FIG. 12 shows an exemplary diagram illustrating a current curve 1205 showing the current that may be drawn by the motor 201 during an overcurrent event during the closing operation of the drape 108. Line 1200 illustrates the OCTH value for the illustrated travel segment ($S_n$) 1207. The controller 110 may continuously measure current levels during the drape's travel and detect an overcurrent event as soon as the current level crosses the OCTH value 1200 at crossover point 1204.

According to an embodiment, the overcurrent operation may comprise completely stopping the motor 201, stopping the motor 201 and reversing the direction of the motor 201 by a predetermined number of revolutions, or the like. Another exemplary overcurrent operation is illustrated in FIG. 11.

According to an embodiment, as illustrated in FIG. 10, the controller 110 may comprise a speed control loop 1000 configured for maintaining the speed of the drape 108 by varying the power of the motor 201 according to detected torque requirements. The speed control loop 1000 may contain a proportional-integral-derivative (PID) controller 1001 that feeds a power module 1004, which powers the motor 201. The PID controller 1001 compares a reference speed ($S_{ref}$) 1006 with a real speed ($S_{real}$) 1008. The reference speed ($S_{ref}$) 1006 may be stored in memory 203. The real speed ($S_{real}$) 1008 comes from the Hall effect sensor 204 that measures the actual speed of the motor 201. The PID controller 1001 determines a power value to adjust the speed of the motor 201 based on the difference between the real speed ($S_{real}$) 1008 and the reference speed ($S_{ref}$) 1006 to either increase or decrease power fed to the motor 201. According to an embodiment, as described with reference to FIG. 11 below, the overcurrent operation may affect the operation of this speed control loop 1000.

FIG. 11 is a flowchart 1100 that illustrates an overcurrent operation according to one embodiment. In step 1102, the controller 110 may detect an overcurrent event as described above with reference to FIG. 9. Referring to FIG. 12, the controller 110 may detect an overcurrent event as soon as the measured current level ($I_L$) 1205 goes above the OCTH value 1200 at crossover point 1204. After detecting the overcurrent event, the controller 110 may prevent the PID controller 1001 from increasing power to the motor 201 in step 1104. According to one embodiment, the PID controller 1001 may still be allowed to decrease the applied power to the motor 201. According to another embodiment, the controller 110 may instead completely pause the operation of the PID controller such that the PID controller 1001 will cease controlling the power fed to the motor 201. Either of these implementations will prevent an overcurrent runaway condition—a condition of spiking the current. An overcurrent runaway condition may occur when the drape 108 encounters an object causing the PID controller 1001 to compensate for the speed and the motor 201 to consume excessive power. Since the motor 201 will be prevented to reach the desired speed by the encountered object, the PID controller 1001 might excessively overshoot the target speed by injecting additional power. As such, in step 1104, the PID controller 1001 is prevented from increasing power to the motor 201 and may be paused, causing the motor 201 to operate at a constant or lower power. According to one embodiment, the controller 110 may prevent the PID controller 1001 from increasing power to the motor 201, or completely pause the PID controller 1001, immediately upon detecting an overcurrent event—i.e., as soon as the measured current level ($I_L$) 1205 goes above the OCTH value 1200 at crossover point 1204. According to another embodiment, the function of the PID controller 1001 would not be effected until the measured current level ($I_L$) 1205 goes above the OCTH value 1200 by a predetermined percentage value.

Referring to FIG. 12, after the detection of the overcurrent event, two possible scenarios may occur. In a first scenario, as indicated by current curve 1201, the controller 110 may continue to detect current levels that exceed the OCTH value 1200, indicating that an object continues to obstruct the drape 108. In a second scenario, as indicated by current curve 1202, shortly after the overcurrent event the current levels may drop below the OCTH value 1200. This can occur during an erroneous current level reading, or when an object only momentarily contacts the drape 108 during movement. As such, in step 1106, the controller 110 determines whether the measured current level went beyond the OCTH value for more than a predetermined maximum amount of time ($T_{max}$). According to an embodiment, the predetermined maximum amount of time ($T_{max}$) may comprise about 40 milliseconds to about 50 milliseconds. In other words, the controller 110 determines whether the length of time of the overcurrent event ($T_{oe}$) is larger than the predetermined maximum amount of time ($T_{max}$). According to another embodiment, in a drapery track assembly 100 that includes the touch reaction feature described above, the predetermined maximum amount of time ($T_{max}$) may be used to detect a valid pull to stop gesture.

If the overcurrent event time ($T_{oe}$) is larger than the predetermined maximum amount of time ($T_{max}$) (i.e., first scenario), then the controller 110 may stop the motor 201 or stop and reverse the motor 201 in step 1108. For example, referring to FIG. 12, the current levels 1201 may cross the OCTH line 1200 at point 1204 and continue to be above the OCTH line 1200 for longer than the predetermined maximum amount of time ($T_{max}$) 1208.

If the overcurrent event time ($T_{oe}$) is smaller than the predetermined maximum amount of time ($T_{max}$) (i.e., second scenario), then the controller 110 may resume normal operation of the PID controller 1001 in step 1110 once the measured current level ($I_L$) goes below the OCTH value 1200, given hysteresis. As such, the PID controller 1001 may resume increasing or decreasing the power fed to the motor 201 as required. For example, referring to FIG. 12, the current levels 1202 may cross the OCTH line 1200 at point 1204 and then go back down below the OCTH line 1200 within the predetermined maximum amount of time ($T_{max}$) 1208. Because the current levels return to be below the OCTH value, the controller 110 resumes its normal operation in step 1112 and the motor 201 continues to move the drapery 108 along track 102.

According to another embodiment, for a drapery track assembly 100 that does not utilize a PID controller 1001, overcurrent operation 1100 shown in FIG. 11 may still be performed, but without steps 1104 and 1110.

INDUSTRIAL APPLICABILITY

The disclosed embodiments provide a system, software, and a method for automatic torque calibration for drapery track systems in order to detect pulling of the drape as well as obstacles to minimize damages to the drapery system. It should be understood that this description is not intended to limit the embodiments. On the contrary, the embodiments are intended to cover alternatives, modifications, and equivalents, which are included in the spirit and scope of the embodiments as defined by the appended claims. Further, in the detailed description of the embodiments, numerous specific details are set forth to provide a comprehensive understanding of the claimed embodiments. However, one skilled in the art would understand that various embodiments may be practiced without such specific details.

Although the features and elements of aspects of the embodiments are described being in particular combinations, each feature or element can be used alone, without the other features and elements of the embodiments, or in various combinations with or without other features and elements disclosed herein.

This written description uses examples of the subject matter disclosed to enable any person skilled in the art to practice the same, including making and using any devices or systems and performing any incorporated methods. The patentable scope of the subject matter is defined by the claims, and may include other examples that occur to those skilled in the art. Such other examples are intended to be within the scope of the claims.

The above-described embodiments are intended to be illustrative in all respects, rather than restrictive, of the embodiments. Thus the embodiments are capable of many variations in detailed implementation that can be derived from the description contained herein by a person skilled in the art. No element, act, or instruction used in the description of the present application should be construed as critical or essential to the embodiments unless explicitly described as such. Also, as used herein, the article "a" is intended to include one or more items.

Additionally, the various methods described above are not meant to limit the aspects of the embodiments, or to suggest that the aspects of the embodiments should be implemented following the described methods. The purpose of the described methods is to facilitate the understanding of one or more aspects of the embodiments and to provide the reader with one or many possible implementations of the processed discussed herein. The steps performed during the described methods are not intended to completely describe the entire process but only to illustrate some of the aspects discussed above. It should be understood by one of ordinary skill in the art that the steps may be performed in a different order and that some steps may be eliminated or substituted. For example, step 502 in FIG. 5 may be eliminated, steps 702 through 708 in FIG. 7 may be performed in any order and steps 705, 712, or 714 may be eliminated, steps 802 and 804 and steps 808 and 812 in FIG. 8 may be performed in any order, and steps 1104 and 1110 in FIG. 11 may be eliminated.

All United States patents and applications, foreign patents, and publications discussed above are hereby incorporated herein by reference in their entireties.

Alternate Embodiments

Alternate embodiments may be devised without departing from the spirit or the scope of the different aspects of the embodiments.

What is claimed is:

1. A drapery track assembly comprising:

a track;

at least one drape attached to the track;

a motor configured for moving the drape along the track;

a sensor configured for determining a position of the drape along the track;

a current sensing circuit configured for detecting current levels; and a controller configured for controlling the motor and comprising at least one memory, wherein the controller is configured for determining a multi-point overcurrent threshold (OCTH) profile by:

storing positions of a plurality of travel segments of a full run of the drape along the track;

moving the drape along the track;

for each traveled travel segment:

capturing a plurality of current levels during travel;

calculating an overcurrent threshold (OCTH) value using the captured current levels;

for each traveled travel segment following a first travel segment:

comparing the calculated overcurrent threshold (OCTH) value of the given travel segment to an overcurrent threshold (OCTH) value of a preceding travel segment;

when the calculated overcurrent threshold (OCTH) value of the given travel segment is larger than the overcurrent threshold (OCTH) value of a preceding travel segment, storing the calculated overcurrent threshold (OCTH) value of the given travel segment in the memory; and when the calculated overcurrent threshold (OCTH) value of the given travel segment is smaller than the overcurrent threshold (OCTH) value of a preceding travel segment, discarding the calculated overcurrent threshold (OCTH) value of the given travel segment, and storing the overcurrent threshold (OCTH) value of the preceding travel segment for the given travel segment;

wherein the controller uses the multi-point overcurrent threshold (OCTH) profile during normal operation to detect an overcurrent event and perform an overcurrent operation.

2. The drapery track assembly of claim 1, wherein the controller determines a first multi-point overcurrent threshold (OCTH) profile for an opened to closed direction and a second multi-point overcurrent threshold (OCTH) profile for a closed to opened direction.

3. The drapery track assembly of claim 2, wherein the first multi-point overcurrent threshold (OCTH) profile is determined by moving the drape through substantially the full run along the track in the opened to closed direction, and wherein the second multi-point overcurrent threshold (OCTH) profile is determined by moving the drape through substantially the full run along the track in the closed to opened direction.

4. The drapery track assembly of claim 1, wherein the multi-point overcurrent threshold (OCTH) profile comprises a vector of the overcurrent threshold (OCTH) values.

5. The drapery track assembly of claim 1, wherein in determining the multi-point overcurrent threshold (OCTH) profile, the controller is further configured for:

dividing the full run of the drape along the track into the plurality of travel segments.

6. The drapery track assembly of claim 1, wherein the full run of the drape along the track comprises a run of the drape from a close hard limit to an open hard limit or from an open hard limit to a close hard limit, wherein the controller automatically determines the positions of the plurality of travel segments by:

determining the close hard limit by directing the motor to move the drape to a fully closed position until the drape reaches a closed physical hard limit;

determining the open hard limit by directing the motor to move the drape to a fully opened position until the drape reaches an opened physical hard limit; and dividing the full run of the drape along the track into the plurality of travel segments.

7. The drapery track assembly of claim 1, wherein the controller is configured for determining the multi-point overcurrent threshold (OCTH) profile by moving the drape through substantially the full run by moving the drape from a substantially opened position to a substantially closed position or moving the drape from a substantially closed position to a substantially opened position.

8. The drapery track assembly of claim 1, wherein the memory stores a fixed minimum value ($F_v$), and wherein for each traveled travel segment the controller calculates the overcurrent threshold (OCTH) value by:

determining a peak value ($P_v$) of the plurality of the captured current levels;

determining a percentage of an average value ($A_v$) of the plurality of the captured current levels; and adding the fixed minimum value ($F_v$), the peak value ($P_v$), and the percentage of an average value ($A_v$).

9. The drapery track assembly of claim 8, wherein for each traveled travel segment the controller further filters out bad data by discarding captured current levels that equal to zero or exceed an allowable current level range.

10. The drapery track assembly of claim 8, wherein the percentage of an average value ($A_v$) is determined by calculating an average of the plurality of the captured current levels of the traveled travel segment, and calculating a percentage of that average.

11. The drapery track assembly of claim 10, wherein the percentage is a predetermined percentage value stored in the memory and comprises a value in a range of about 5% to about 25%.

12. The drapery track assembly of claim 1, wherein the multi-point overcurrent threshold (OCTH) profile is automatically determined upon the drapery track assembly's installation in the field, during a first operation of the drapery track assembly, after a power up of the drapery track assembly, upon receiving a command to determine the multi-point overcurrent threshold (OCTH) profile, upon receiving a reset command, when the speed of the motor is changed, or when a closed or opened hard limits are changed.

13. The drapery track assembly of claim 1, wherein the multi-point overcurrent threshold (OCTH) profile is automatically determined by updating the multi-point overcurrent threshold (OCTH) profile during normal operation of the drapery track assembly.

14. The drapery track assembly of claim 13, wherein the controller updates the multi-point overcurrent threshold (OCTH) profile when (a) the drape travels through substantially the full run along the track, and (b) the drape reaches a fully opened position or a fully closed position with no overcurrent event.

15. The drapery track assembly of claim 14, wherein the controller is further configured for:

waiting for the drape to be at or near an opened hard limit;

waiting for a control command to move the drape to a fully closed position;

when the drape reaches the fully closed position with no overcurrent event, determining a multi-point overcurrent threshold (OCTH) profile in an opened to closed direction; and when an overcurrent event was detected, discarding the captured plurality of current levels.

16. The drapery track assembly of claim 15, wherein the drape is near the opened hard limit when the drape is within about 10% of the opened hard limit.

17. The drapery track assembly of claim 14, wherein the controller is further configured for:

waiting for the drape to be at or near a closed hard limit;

waiting for a control command to move the drape to a fully opened position;

when the drape reaches a fully opened position with no overcurrent event, determining a multi-point overcurrent threshold (OCTH) profile in a closed to opened direction; and when an overcurrent event was detected, discarding the captured plurality of current levels.

18. The drapery track assembly of claim 17, wherein the drape is near the closed hard limit when the drape is within about 10% of the closed hard limit.

19. The drapery track assembly of claim 1, wherein during normal operation the controller is configured for detecting the overcurrent event by:

measuring current levels as the drape travels along the track; and detecting an overcurrent event when a measured current level within a travel segment exceeds the overcurrent threshold (OCTH) value of that travel segment.

20. The drapery track assembly of claim 19, wherein during normal operation the controller is further configured for detecting the overcurrent event by:

receiving a control command to move the drape;

tracking position to determine present travel segment;

measuring current levels as the drape travels within the present travel segment; and comparing each measured current level to the overcurrent threshold (OCTH) value that corresponds to the present travel segment.

21. The drapery track assembly of claim 1, wherein the overcurrent operation comprises at least one of stopping the motor, and stopping and reversing the motor by a predetermined number of revolutions.

22. The drapery track assembly of claim 1, wherein upon detecting the overcurrent event, the controller is further configured for:

continuing moving the drape and measuring current levels;

determining whether a length of time of the overcurrent event is larger than a predetermined maximum amount of time;

when the overcurrent event time is smaller than the maximum amount of time, resuming normal operation; and when the overcurrent event time is larger than the maximum amount of time, performing the overcurrent operation.

23. The drapery track assembly of claim 1, wherein the drapery track assembly further comprises a proportional-integral-derivative (PID) controller configured for maintaining the speed of the drape by varying the power of the motor, wherein upon detecting the overcurrent event, the controller is further configured for:

preventing the proportional-integral-derivative (PID) controller from increasing power to the motor;

continuing moving the drape and measuring current levels;

determining whether a length of time of the overcurrent event is larger than a predetermined maximum amount of time;

when the overcurrent event time is smaller than the maximum amount of time, resuming normal operation of the proportional-integral-derivative (PID) controller; and when the overcurrent event time is larger than the maximum amount of time, performing the overcurrent operation.

24. The drapery track assembly of claim 23, wherein preventing the proportional-integral-derivative (PID) controller from increasing power to the motor comprises pausing the proportional-integral-derivative (PID) controller.

25. The drapery track assembly of claim 23, wherein the overcurrent operation comprises at least one of stopping the motor, and stopping and reversing the motor by a predetermined number of revolutions.

26. The drapery track assembly of claim 1, wherein when the controller receives a control command to move the drape after detecting the overcurrent event, the controller cancels the overcurrent operation.

27. A drapery track assembly comprising:

a track;

at least one drape attached to the track;

a motor configured for moving the drape along the track;

a sensor configured for determining a position of the drape along the track;

a current sensing circuit configured for detecting current levels; and a controller configured for controlling the motor and comprising at least one memory, wherein the controller is configured for:

determining at least one overcurrent threshold (OCTH) value by:

moving the drape along the track;

capturing a plurality of current levels during travel;

determining at least one overcurrent threshold (OCTH) value; and storing the overcurrent threshold (OCTH) value in the memory;

detecting an overcurrent event by:

receiving a control command to move the drape;

measuring current levels as the drape travels along the track;

detecting an overcurrent event when a measured current level exceeds the at least one overcurrent threshold (OCTH) value;

continuing moving the drape and measuring current levels;

determining whether a length of time of the overcurrent event is larger than a predetermined maximum amount of time;

when the overcurrent event time is smaller than the maximum amount of time, resuming normal operation of the drape; and when the overcurrent event time is larger than the maximum amount of time, performing an overcurrent operation.

28. The drapery track assembly of claim 27, wherein the drapery track assembly further comprises a proportional-integral-derivative (PID) controller configured for maintaining the speed of the drape by varying the power of the motor, wherein the controller is further configured for:

upon detecting the overcurrent event, preventing the proportional-integral-derivative (PID) controller from increasing power to the motor;

when the overcurrent event time is smaller than the maximum amount of time, resuming normal operation of the proportional-integral-derivative (PID) controller; and when the overcurrent event time is larger than the maximum amount of time, continuing to prevent the proportional-integral-derivative (PID) controller from increasing power to the motor.

29. The drapery track assembly of claim 28, wherein preventing the proportional-integral-derivative (PID) controller from increasing power to the motor comprises pausing the proportional-integral-derivative (PID) controller.

30. A drapery track assembly comprising:
a track;
at least one drape attached to the track;
a motor configured for moving the drape along the track;
a sensor configured for determining a position of the drape along the track;
a current sensing circuit configured for detecting current levels; and
a controller configured for controlling the motor and comprising at least one memory, wherein the controller is configured for determining at least one overcurrent threshold (OCTH) value by:
storing a fixed minimum value ($F_v$);
moving the drape along the track;
capturing a plurality of current levels;
calculating the at least one overcurrent threshold (OCTH) value by:
determining a peak value ($P_v$) of at least a subset of the plurality of the captured current levels;
determining a percentage of an average value ($A_v$) of at least the subset of the plurality of the captured current levels; and
adding the fixed minimum value ($F_v$), the peak value ($P_v$), and the percentage of an average value ($A_v$); and
storing the at least one overcurrent threshold (OCTH) value in the memory;
wherein the controller uses the at least one overcurrent threshold (OCTH) value during normal operation to detect an overcurrent event and perform an overcurrent operation.

31. The drapery track assembly of claim 30, wherein the at least one overcurrent threshold (OCTH) value is automatically updated during normal operation of the drapery track assembly when (a) the drape travels through substantially the full run along the track, and (b) the drape reaches a fully opened position or a fully closed position with no overcurrent event.

32. A motorized window treatment assembly comprising:
a window covering material;
a motor configured for moving the window covering material from an opened position to a closed position;
a sensor configured for determining a position of the window covering material;
a current sensing circuit configured for detecting current levels; and
a controller configured for controlling the motor and comprising at least one memory, wherein the controller is configured for:
determining a multi-point overcurrent threshold (OCTH) profile by:
storing positions of a plurality of travel segments of a full run of the window covering material from a fully closed position to a fully opened position or from a fully opened position to a fully closed position;
moving the window covering material;
for each traveled travel segment, capturing a plurality of current levels during travel and calculating an overcurrent threshold (OCTH) value using the captured current levels; and
storing the overcurrent threshold (OCTH) values in the memory;
using the multi-point overcurrent threshold (OCTH) profile during normal operation to detect an overcurrent event and perform an overcurrent operation, wherein upon detecting the overcurrent event, the controller is further configured for:
continuing moving the drape and measuring current levels;
determining whether a length of time of the overcurrent event is larger than a predetermined maximum amount of time;
when the overcurrent event time is smaller than the maximum amount of time, resuming normal operation; and
when the overcurrent event time is larger than the maximum amount of time, performing the overcurrent operation.

33. The motorized window treatment assembly of claim 32, wherein the controller determines a first multi-point overcurrent threshold (OCTH) profile for an opened to closed direction and a second multi-point overcurrent threshold (OCTH) profile for a closed to opened direction.

34. A drapery track assembly comprising:
a track;
at least one drape attached to the track;
a motor configured for moving the drape along the track;
a sensor configured for determining a position of the drape along the track;
a current sensing circuit configured for detecting current levels; and
a controller configured for controlling the motor and comprising at least one memory, wherein the controller is configured for determining a multi-point overcurrent threshold (OCTH) profile by:
determining a close hard limit by directing the motor to move the drape to a fully closed position until the drape reaches a closed physical hard limit;
determining an open hard limit by directing the motor to move the drape to a fully opened position until the drape reaches an opened physical hard limit;
dividing a full run of the drape along the track from the close hard limit to the open hard limit or from the open hard limit to the close hard limit into the plurality of travel segments;
storing positions of the plurality of travel segments of the full run of the drape along the track;
moving the drape along the track;
for each traveled travel segment, capturing a plurality of current levels during travel and calculating an overcurrent threshold (OCTH) value using the captured current levels; and
storing the overcurrent threshold (OCTH) values in the memory;
wherein the controller uses the multi-point overcurrent threshold (OCTH) profile during normal operation to detect an overcurrent event and perform an overcurrent operation.

* * * * *